US010443937B2

(12) United States Patent
Natsume

(10) Patent No.: US 10,443,937 B2
(45) Date of Patent: Oct. 15, 2019

(54) PAINT BAKING OVEN AND PAINT BAKING METHOD

(71) Applicant: Nissan Motor Co., Ltd., Yokohama-shi, Kanagawa (JP)

(72) Inventor: Tomoyuki Natsume, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 181 days.

(21) Appl. No.: 15/545,114

(22) PCT Filed: Jan. 26, 2015

(86) PCT No.: PCT/JP2015/051996
§ 371 (c)(1),
(2) Date: Jul. 20, 2017

(87) PCT Pub. No.: WO2016/120967
PCT Pub. Date: Aug. 4, 2016

(65) Prior Publication Data

US 2017/0370645 A1 Dec. 28, 2017

(51) Int. Cl.

| | |
|---|---|
| ***F26B 19/00*** | (2006.01) |
| ***F26B 15/12*** | (2006.01) |
| ***B05D 7/14*** | (2006.01) |
| ***B05B 9/04*** | (2006.01) |
| ***B05D 3/02*** | (2006.01) |
| ***F26B 15/14*** | (2006.01) |
| ***F26B 21/00*** | (2006.01) |
| ***B05B 9/03*** | (2006.01) |

(Continued)

(52) U.S. Cl.
CPC ..... *F26B 15/12* (2013.01); *B05B 9/03* (2013.01); *B05B 9/04* (2013.01); *B05D 3/02* (2013.01); *B05D 3/0254* (2013.01); *B05D 7/14* (2013.01); *F26B 15/14* (2013.01); *F26B 21/004* (2013.01); *F26B 21/10* (2013.01); *F26B 25/06* (2013.01); *F26B 2210/12* (2013.01)

(58) Field of Classification Search
CPC ..... F26B 25/06; F26B 25/063; F26B 15/14; F26B 21/004; F26B 2210/12; B05D 3/0254; B05D 3/02; B05D 7/14
USPC ..... 34/666, 202, 201, 215, 216; 427/372.2
See application file for complete search history.

(56) References Cited

U.S. PATENT DOCUMENTS 5,456,023 A 10/1995 Farnan
7,181,864 B1 2/2007 Coss
(Continued)

FOREIGN PATENT DOCUMENTS

CN 102906521 A 1/2013
DE 102009046407 A1 5/2011
(Continued)

*Primary Examiner* — John P McCormack
(74) *Attorney, Agent, or Firm* — Young Basile Hanlon & MacFarlane, P.C.

(57) ABSTRACT

A paint baking oven comprises an oven body and a hot air supplier that supplies hot air into the oven body. The paint baking oven bakes a wet coating applied to a vehicle body while conveying the vehicle body. The vehicle body includes a body exterior part and a narrow portion. The oven body is configured to include a spot baking region in which the hot air is blown primarily toward the narrow portion to locally bake a coating film applied to the narrow portion.

8 Claims, 26 Drawing Sheets

(51) Int. Cl.
*F26B 21/10* (2006.01)
*F26B 25/06* (2006.01)

(56) References Cited

U.S. PATENT DOCUMENTS

| | | | | |
|---|---|---|---|---|
| 2005/0100685 | A1* | 5/2005 | Flosbach | B05D 3/067 428/31 |
| 2006/0222778 | A1* | 10/2006 | Dixon | B05D 3/0209 427/542 |
| 2007/0261264 | A1* | 11/2007 | Ortlieb | B60S 3/002 34/666 |
| 2013/0061489 | A1 | 3/2013 | Sato | |
| 2013/0312277 | A1* | 11/2013 | Hihn | F26B 15/14 34/666 |
| 2016/0368022 | A1 | 12/2016 | Ohta et al. | |

FOREIGN PATENT DOCUMENTS

| | | | |
|---|---|---|---|
| DE | 102011117666 | A1 | 5/2013 |
| EP | 2071260 | A1 | 6/2009 |
| JP | 5646975 | A | 4/1981 |
| JP | H04081378 | A | 3/1992 |
| JP | 2004050021 | A | 2/2004 |
| JP | 2007271255 | A | 10/2007 |
| JP | 2015009222 | A | 1/2015 |

* cited by examiner

PAINT BAKING OVEN AND PAINT BAKING METHOD

TECHNICAL FIELD

The present invention relates to a paint baking oven and a paint baking method.

BACKGROUND

For the purposes of productivity improvement and adjustability of body color in a coating process line for vehicle bodies, various processes are performed, such as processes for an electrodeposition coat (under coat), intermediate coat and topcoat and antirust treatment, in a state in which lid parts such as doors and hoods are attached to main shell bodies. In the processes for an intermediate coat and topcoat, the vehicle body as an object to be coated is placed on a transfer trolley, applied with paint while being conveyed in a paint coating booth, and carried into a paint baking oven for baking of a wet coating film. The paint baking oven used in the coating process line is configured such that a tunnel-shaped oven body is provided with an air supply duct for hot air and the hot air is blown to the whole vehicle body, which is being conveyed in the oven body, to bake the wet coating film (See JP2004-50021A).

A baking curable-type paint is used for vehicle bodies. The quality assurance standard for the cured coating film is, for example, holding of 140° C.×20 minutes for an intermediate paint and topcoat paint. In the conventional paint baking oven, however, the hot air is less likely to go around into narrow portions, such as those around hinges of doors, because of the structure of the vehicle body as compared with the body exterior parts to which the hot air is easy to blow. Thus, unfortunately, the narrow portions cannot readily satisfy the above-described quality assurance standard, such as holding of 140° C.×20 minutes.

SUMMARY

A problem to be solved by the present invention is to provide a paint baking oven and paint baking method that are able to satisfy the baking condition for a wet coating film across the whole vehicle body.

The present invention solves the above problem by providing an oven body with a spot baking region in which hot air is blown primarily toward a narrow portion of a vehicle body to locally bake a coating film applied to the narrow portion.

Effect of Invention

According to the present invention, the hot air is blown locally toward the narrow portion of the vehicle body and a predetermined baking condition can thereby be satisfied even for a wet coating film applied to the narrow portion.

DETAILED DESCRIPTION OF THE EMBODIMENTS

Hereinafter, best modes for carrying out the present invention will be described with reference to one or more embodiments in which the paint baking oven and paint baking method of the present invention are applied to a topcoat paint baking oven 1, but the paint baking oven and paint baking method of the present invention can also be applied to an intermediate paint baking oven and an under paint baking oven (electrodeposition paint baking oven), or to an intermediate paint and topcoat paint baking oven which will be described later, other than the topcoat paint baking oven.

The topcoat paint baking oven 1 according to one or more embodiments of the present invention is one of devices that constitute a coating process line PL. The topcoat paint baking oven 1 is a device for baking a top coating film, which is applied to a shell body B (referred also to as a "vehicle body B") loaded on a transfer trolley 50, while conveying the shell body B. In the following description, the overview of a production line and the coating process line PL for vehicles will first be described and the vehicle body B and the topcoat paint baking oven 1 will then be described in detail.

The production line for vehicles is composed mainly of four lines: a press-forming process line PRL; a shell body assembly process line (referred also to as a "welding process line") WL; a coating process line PL; and a vehicle component assembly process line (referred also to as an "outfitting process line") ASL. In the press-forming process line PRL, various panels that constitute a vehicle body B are press-formed and each conveyed in a state of a single pressed component to the shell body assembly process line WL. In the shell body assembly process line WL, subassemblies are assembled for respective sites of the vehicle body, such as a front body, center floor body, rear floor body and side bodies, and welding is performed for predetermined parts of the assembled front body, center floor body and rear floor body to assemble an under body, to which the side bodies and a roof panel are welded to assemble a main shell body B1 (which refers to a shell body excluding lid parts). Finally, preassembled lid parts such as a hood F, side doors D1 and D2 and trunk lid T (or back door) are attached to the main shell body B1 via hinges H (which will be described later with reference to FIG. 2F). After passing through the coating process line PL, the shell body finished with coating is conveyed to the vehicle component assembly process line ASL, in which various vehicle components such as an engine, transmission, suspension devices and interior components are assembled into the shell body.

Figure 1A:
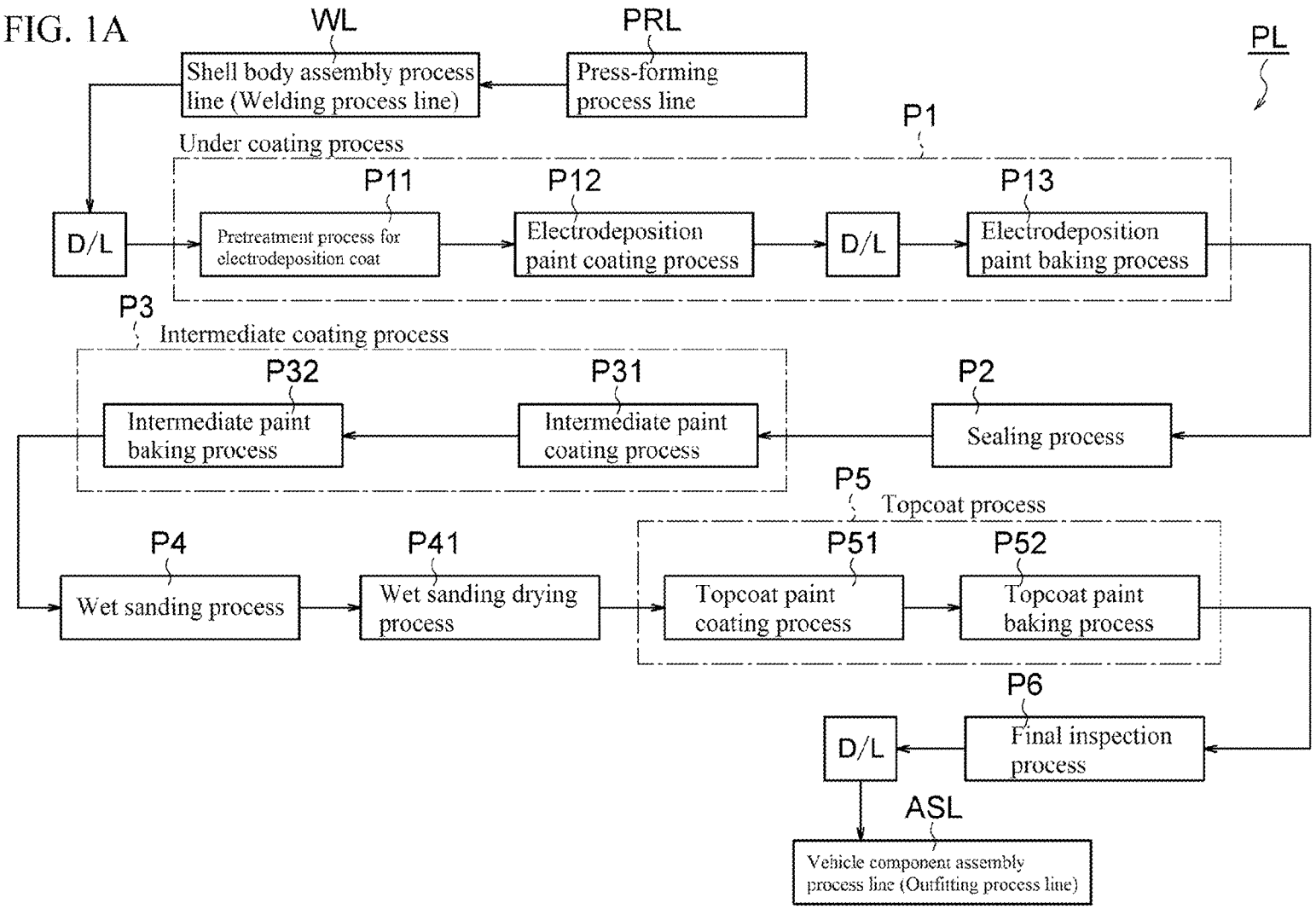
FIG. 1A is an overall process chart illustrating an example of a coating process line to which one or more embodiments of the paint baking oven and method according to the present invention are applied.
Figure 1B:
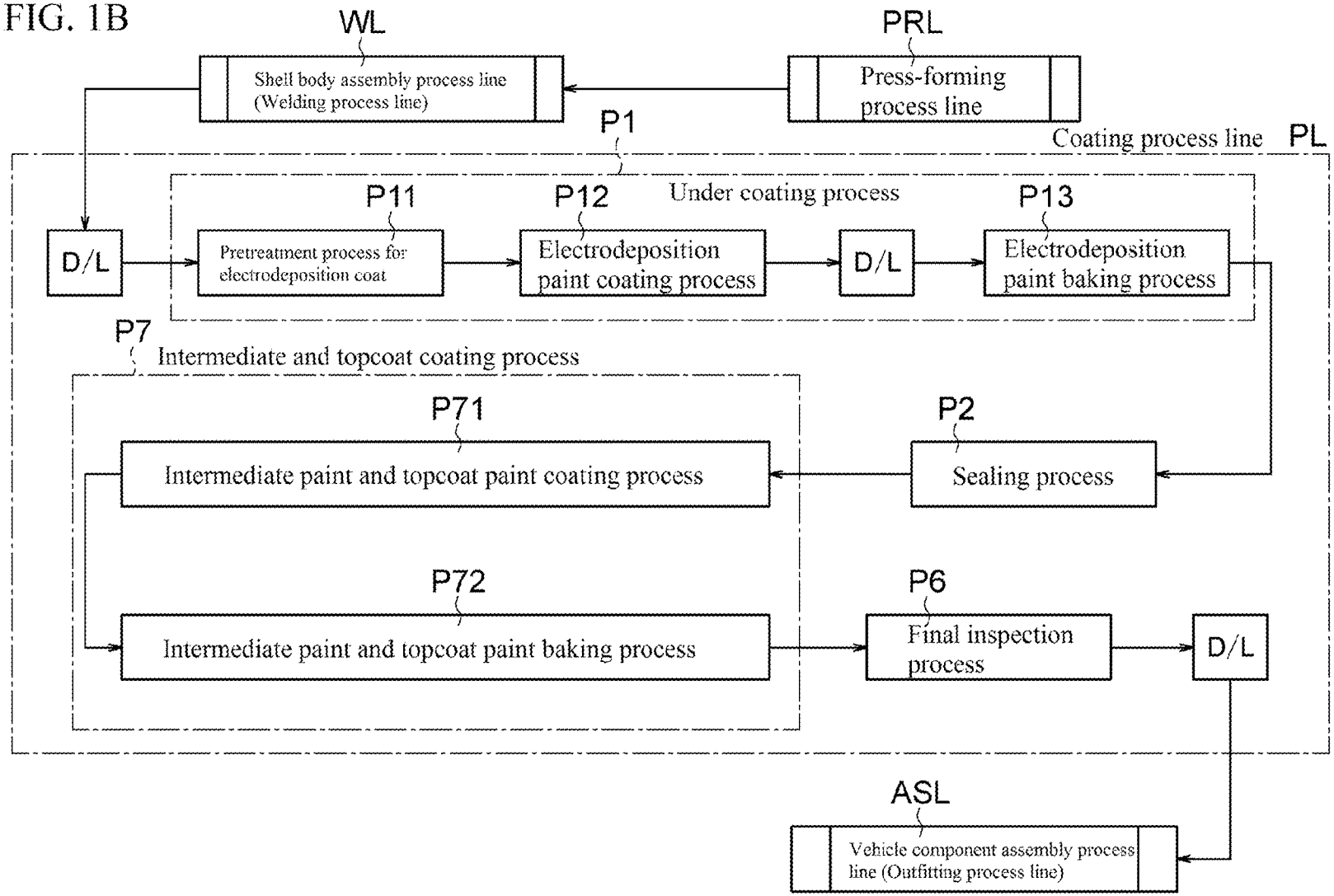
FIG. 1B is an overall process chart illustrating another example of a coating process line to which one or more embodiments of the paint baking oven and method according to the present invention are applied.

General configuration of the coating process line PL will then be described. FIG. 1A and FIG. 1B are each an overall process chart illustrating the coating process line PL including a topcoat paint baking oven to which the paint baking oven and method according to the present invention are applied. The coating process line PL of the embodiment illustrated in FIG. 1A is a coating process line using a three-coat three-bake coating method of under coating, intermediate coating and top coating. In contrast, the coating process line PL of the embodiment illustrated in FIG. 1B is a coating process line using a three-coat two-bake coating method in which coating with an intermediate paint and a topcoat paint is performed in a wet-on-wet condition (a condition of coating an uncured coating film with another paint, here and hereinafter) in the same coating booth and the intermediate coating film and the top coating film are simultaneously baked in the same paint baking oven. Thus, the paint baking oven and method according to the present invention can be applied to both the coating process lines with different coating methods. The paint baking oven and method according to the present invention can also be applied to various cases by modifying a part of this kind of typical coating process line PL. Such cases include a case of four-coat coating method in which the three-coat three-bake coating method and the three-coat two-bake coating method are modified to perform the intermediate coating twice and a case in which the topcoat color is an optional body color, such as two-tone color. The following description is in line with both the coating process lines of FIG. 1A and FIG. 1B. Common features are denoted by the same characters and will be described with reference to the coating process line of FIG. 1A. With regard to different features between the coating process lines of FIG. 1A and FIG. 1B, the difference will be described with reference to FIG. 1B.

The coating process line PL of the embodiment illustrated in FIG. 1A comprises an under coating process P1, sealing process P2, intermediate coating process P3, wet sanding process P4, topcoat process P5, and final inspection process P6. In contrast, the coating process line PL of the embodiment illustrated in FIG. 1B comprises an under coating process P1, sealing process P2, intermediate and topcoat coating process P7, and final inspection process P6. That is, in the coating process line PL of FIG. 1B, two processes of an intermediate paint coating process P31 and topcoat paint coating process P51 illustrated in FIG. 1A are performed in one process of an intermediate paint and topcoat paint coating process P71 of FIG. 1B and, similarly, an intermediate paint baking process P32 and topcoat paint baking process P52 illustrated in FIG. 1A are performed in one process of an intermediate paint and topcoat paint baking process P72 of FIG. 1B. The intermediate and topcoat coating process P7 of FIG. 1B will be described later.

As illustrated in FIG. 1A and FIG. 1B, the under coating process P1 comprises an pretreatment process for electrodeposition coat P11, electrodeposition paint coating process P12, and electrodeposition paint baking process P13. In the pretreatment process for electrodeposition coat P11, the vehicle bodies B (white bodies), which are each transferred from the transfer trolley of the shell body assembly process line WL to a hanger (not illustrated) using a drop-lifter D/L, are successively conveyed by an overhead conveyor with a predetermined pitch at a predetermined conveying speed. The structure of a vehicle body B will be described later.

Although not illustrated, the pretreatment process for electrodeposition coat P11 comprises a degreasing process, water-washing process, surface conditioning process, chemical conversion film forming process, water-washing process, and water-draining process. In the press-forming process line PRL and the shell body assembly process line WL, press oil and dust such as iron powder due to welding are attached to the vehicle body B. When the vehicle body B is carried into the coating process line PL, therefore, the degreasing process and the water-washing process are used to wash and remove such oil and dust. In the surface conditioning process, surface conditioner components are adsorbed to the surface of the vehicle body B thereby to increase the number of reaction starting points in the subsequent chemical conversion film forming process. The adsorbed surface conditioner components act as nuclei of coating film crystals to accelerate the film forming reaction. In the chemical conversion film forming process, the vehicle body B is immersed in a chemical conversion treatment liquid, such as zinc phosphate solution, to form a chemical conversion film on the surface of the vehicle body B. In the water-washing process and the water-draining process, the vehicle body B is washed with water and then dried.

In the electrodeposition paint coating process P12, the vehicle bodies B pretreated in the pretreatment process for electrodeposition coat P11 are successively conveyed by an overhead conveyor with a predetermined pitch at a predetermined conveying speed. Each vehicle body B is then immersed in a boat-shaped electrodeposition bath that is filled with an electrodeposition paint and a high voltage is applied between a plurality of electrode plates provided in the electrodeposition bath and the vehicle body B (specifically a hanger having electrical conductivity). This allows the surface of the vehicle body B to be formed with an electrodeposition coating film owing to the electrophoretic action of the electrodeposition paint. Examples of the electrodeposition paint include a thermoset paint of which the primary resin is an epoxy-based resin such as polyamine resin. For the antirust property, it is preferred to use a cation-type electrodeposition paint as the electrodeposition paint, in which case a high voltage for the positive electrode is applied to the side of the electrodeposition paint, but an anion-type electrodeposition paint may also be used. When the anion-type electrodeposition paint is used, a high voltage for the positive electrode is applied to the side of the vehicle body B.

After exiting the electrodeposition bath of the electrodeposition paint coating process P12, the vehicle body B is conveyed to a water-washing process in which the electrodeposition paint attached to the vehicle body B is washed away using industrial water and/or pure water. During this operation, the electrodeposition paint carried out of the electrodeposition bath is recovered in the water-washing process. At the stage completed with the water-washing process, an unbaked electrodeposition coating film having a thickness of about 10 to 35 μm is formed on the surface of the vehicle body B and in the hollow structure parts of the vehicle body B. After completion of the electrodeposition paint coating process P12, the vehicle body B loaded on a hanger is transferred to a transfer trolley 50 (which will be described later with reference to FIG. 2A) using a drop-lifter D/L. The drop-lifter D/L disposed between the electrodeposition paint coating process P12 and the electrodeposition paint baking process P13 illustrated in FIG. 1A and FIG. 1B may otherwise be disposed between the electrodeposition paint baking process P13 and the sealing process P2 and, in the electrodeposition paint baking process P13, the vehicle body may be conveyed in a state of being loaded on a hanger.

In the electrodeposition paint baking process P13, the vehicle bodes B loaded on transfer trolleys are successively conveyed by a floor conveyor with a predetermined pitch at a predetermined conveying speed. Then, for each vehicle body B, baking is performed by maintaining a temperature of 160° C. to 180° C. for 15 to 30 minutes, for example, and a baked electrodeposition coating film having a thickness of 10 to 35 μm is thereby formed on the interior and exterior of the vehicle body B and in the hollow structure parts of the vehicle body B. From the electrodeposition paint baking process P13 to the final inspection process P6, transfer trolleys 50 loaded with vehicle bodies B are successively conveyed using a floor conveyor, but the conveying pitch and conveying speed of the transfer trolleys 50 in each process are appropriately set for the process. The floor conveyor is therefore composed of a plurality of conveyors and the conveying pitch and conveying speed in each process are set as predetermined values.

In the present description and scope of claims, the "paint" such as an electrodeposition paint, intermediate paint and topcoat paint refers to a liquid state before being applied to an object to be coated while the "coating film" such as an electrodeposition coating film, intermediate coating film and top coating film refers to a film-like, unbaked (wet) or baked state after being applied to an object to be coated, and both are thus distinguished. In the present description and scope of claims, the upstream side and the downstream side mean those with reference to the conveying direction of the vehicle body B as an object to be coated. In the present description, conveying the vehicle body B forward means conveying the vehicle body B along the longitudinal direction axis of the vehicle body in a state in which the vehicle front part of the vehicle body B is positioned at the front side in the conveying direction and the vehicle rear part is positioned at the rear side, while conveying the vehicle body B backward means conveying the vehicle body B along the longitudinal direction axis of the vehicle body, conversely, in a state in which the vehicle rear part of the vehicle body B is positioned at the front side in the conveying direction and the vehicle front part is positioned at the rear side. In the under coating process P1 to the final inspection process P6 according to one or more embodiments of the present invention, the vehicle body B may be conveyed forward or may also be conveyed backward.

In the sealing process P2 (which includes a floor back coating process and a stone-guard coating process), the vehicle body B formed with the electrodeposition coating film is conveyed and a sealing material of vinyl chloride-based resin is applied to joining parts of steel panels and edge parts of steel panels for the purpose of antirust or sealing. In the floor back coating process, a vinyl chloride resin-based anti-flipped stone material is applied to wheel housings and a floor back of the vehicle body B. In the stone-guard coating process, an anti-flipped stone material of polyester-based resin or polyurethane-based resin is applied to lower portions of the body exterior, such as side sill panels, fender panels and doors. These sealing material and anti-flipped stone material are to be cured in a dedicated baking process or in the intermediate paint baking process P32 which will be described below.

The intermediate coating process P3 of the coating process line PL of FIG. 1A comprises an intermediate paint coating process P31 and an intermediate paint baking process P32. In the intermediate paint coating process P31, the vehicle body B formed with the electrodeposition coating film is conveyed to an intermediate paint coating booth in which an interior coating paint is applied to the body interior parts of the vehicle body, such as an engine room, hood inner and trunk lid inner. The interior coating paint contains a coloring pigment corresponding to an exterior body color of the vehicle. Then, an intermediate paint is applied to the body exterior parts, such as a hood outer, roof, door outers and trunk lid outer (or back door outer), in a wet-on-wet condition (i.e. without baking the interior coating film). As used herein, the body exterior parts refer to parts that are visible from outside the vehicle finished with the outfitting process and the body interior parts refer to parts that are invisible from outside the finished vehicle.

In the intermediate paint baking process P32 of the coating process line PL of FIG. 1, the vehicle body B is conveyed to an intermediate paint baking oven. Then, the unbaked intermediate coating film is baked by maintaining a temperature of 130° C. to 150° C. for 15 to 30 minutes, for example, and an intermediate coating film having a thickness of 15 to 35 μm is formed on the body exterior parts of the vehicle body B. The interior coating film having a thickness of 15 to 30 μm is also formed on the body interior parts of the vehicle body B. Each of the interior coating paint and the intermediate paint is a thermoset paint of which the primary resin is an appropriate resin, such as acrylic resin, alkyd resin and polyester resin, and may be any of an aqueous paint and organic solvent-based paint.

In the wet sanding process P4 of the coating process line PL of FIG. 1A, the vehicle body B finished with the intermediate coating process P3 and preceding processes is conveyed and the surface of the intermediate coating film formed on the vehicle body B is polished using clean water and a polishing agent. This enhances the interfacial adhesion between the intermediate coating film and the top coating film and improves the smoothness (coating skin and image sharpness/gloss) of the top coating film on the body exterior parts. The wet sanding process P4 is provided with a wet sanding drying process P41 in which the vehicle body B passes through a water-draining oven thereby to dry the water attached to the vehicle body B.

The topcoat process P5 of the coating process line PL of FIG. 1A comprises a topcoat paint coating process P51 and a topcoat paint baking process P52. In the topcoat paint coating process P51, the vehicle body B finished with the wet sanding process P4 and the wet sanding drying process P41 is conveyed. Then, in the topcoat paint coating booth, a topcoat base paint is applied to the body exterior parts of the vehicle body B and a topcoat clear paint is applied to the topcoat base coating film on the body exterior parts of the vehicle body B in a wet-on-wet condition.

Each of the topcoat base paint and the topcoat clear paint is a paint of which the primary resin is an appropriate resin, such as acrylic resin, alkyd resin and polyester resin, and may be any of an aqueous paint and organic solvent-based paint. In consideration of the finishing property such as orientation of bright pigment, the topcoat base paint is diluted to about 80% as the weight ratio for coating (solid content is about 20% to 40%) while the topcoat clear paint is diluted to about 30% as the weight ratio for coating (solid content is about 70% to 80%). In general, however, the applied solid content of the topcoat base paint will increase to 70% or more in a flash-off process (setting process in which the solvent naturally evaporates in the booth) after the application.

The exterior body color of the vehicle body B according to one or more embodiments of the present invention is a metallic-type body color that contains various bright pigments such as aluminum and mica, so the topcoat base paint and the topcoat clear paint are applied to the vehicle body B, but the present invention is not limited to this. For example, the exterior body color of the vehicle body B may be a solid-type body color. The solid-type body color is a coating color that does not contain a bright pigment. In this case, the topcoat base paint is not applied and a topcoat solid paint is applied as substitute for the topcoat clear paint. Examples of such a topcoat solid paint include paints of which the primary resin is the same as that of the topcoat base paint and the topcoat clear paint.

In the topcoat paint baking process P52 according to one or more embodiments of the present invention, the vehicle body B to which the topcoat paint is applied in the topcoat paint coating booth is conveyed to the topcoat paint baking oven 1. In the topcoat paint baking process P52, the vehicle body B is passed through the topcoat paint baking oven 1 under a predetermined condition thereby to form a baked top coating film. Specific configuration of the topcoat paint baking oven 1 and topcoat paint baking process P52 according to one or more embodiments of the present invention will be described later.

The thickness of the topcoat base coating film is, for example, 10 to 20 μm and the thickness of the topcoat clear coating film is, for example, 15 to 30 μm. When the exterior body color is a solid-type body color, the thickness of the topcoat solid coating film is, for example, 15 to 35 μm. Finally, the vehicle body completed with all the above processes (vehicle body finished with coating) is conveyed to the final inspection process P6 in which various tests are performed for evaluation of properties, such as appearance and image sharpness of the coating film.

On the other hand, the coating process line PL illustrated in FIG. 1B includes the intermediate and topcoat coating process P7 which is provided as substitute for the intermediate coating process P3, wet sanding process P4 (including wet sanding drying process P41), and topcoat process P5 of the coating process line PL illustrated in FIG. 1A. The intermediate and topcoat coating process P7 of this embodiment comprises an intermediate paint and topcoat paint coating process P71 and an intermediate paint and topcoat paint baking process P72.

In the intermediate paint and topcoat paint coating process P71 of the coating process line PL illustrated in FIG. 1B, the vehicle body B formed with the electrodeposition coating film is conveyed to an intermediate paint and topcoat paint coating booth that includes a first-half zone and a second-half zone. In the first-half zone, an interior coating paint is applied to the body interior parts of the vehicle body, such as an engine room, hood inner and trunk lid inner. The interior coating paint contains a coloring pigment corresponding to an exterior body color of the vehicle. Then, an intermediate paint is applied to the body exterior parts, such as a hood outer, roof, door outers and trunk lid outer (or back door outer), in a wet-on-wet condition (i.e. without baking the interior coating film). Then, similarly, in the second-half zone of the intermediate paint and topcoat paint coating booth, a topcoat base paint is applied to the body exterior parts of the vehicle body B and a topcoat clear paint is applied to the topcoat base coating film on the body exterior parts of the vehicle body B in a wet-on-wet condition. That is, the interior coating paint, intermediate paint, topcoat base paint and clear paint are all applied in a wet-on-wet condition and simultaneously baked in one topcoat paint baking oven. To suppress troubles of generation of bubbles and deterioration in the image sharpness due to double coating of wet coating films, after the intermediate paint is applied and/or after the topcoat base paint is applied, a flash-off process may be provided for increasing the painted non-volatility value of the wet coating film applied to the vehicle body B. Each of the interior coating paint, intermediate paint, topcoat base paint and clear paint used in this embodiment is a thermoset paint of which the primary resin is an appropriate resin, such as acrylic resin, alkyd resin and polyester resin, as used in the coating process line PL illustrated in FIG. 1A, and may be any of an aqueous paint and organic solvent-based paint.

Figure 2A:
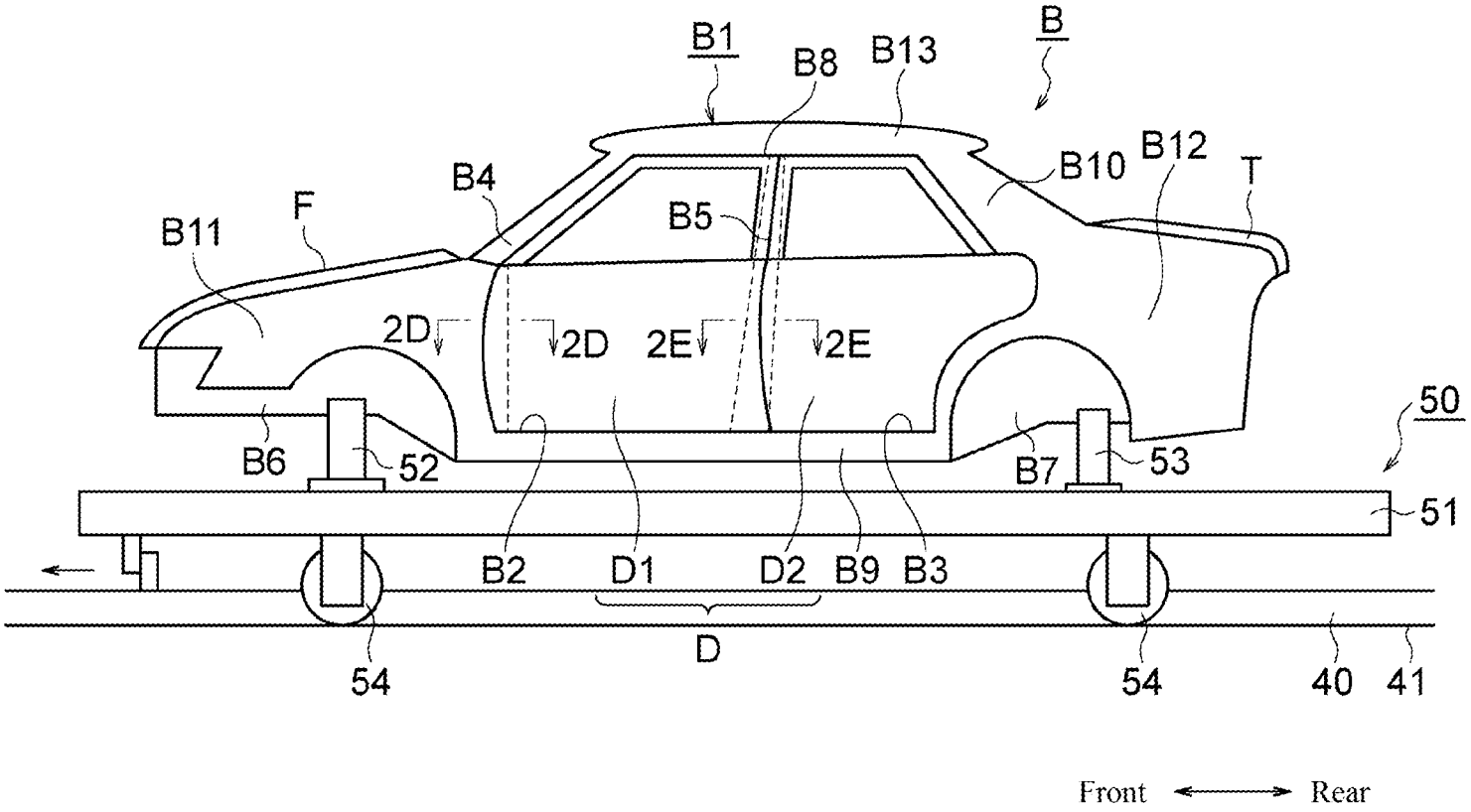
FIG. 2A is a side elevational view illustrating a state in which a vehicle body according to one or more embodiments of the present invention is loaded on a transfer trolley.

Next, an example of the vehicle body B applied to the coating process line PL according to one or more embodiments of the present invention will be described with reference to FIG. 2A to FIG. 2G. FIG. 2A is a side elevational view illustrating a state in which the vehicle body B according to one or more embodiments of the present invention is loaded on the transfer trolley 50, FIG. 2B is a front elevational view of a front door D1 of the vehicle body B according to one or more embodiments of the present invention when viewed from the interior side, FIG. 2C is a front elevational view of a rear door D2 of the vehicle body B according to one or more embodiments of the present invention when viewed from the interior side, FIG. 2D is a cross-sectional view along line 2D-2D of FIG. 2A, that is, a cross-sectional view illustrating an example of a narrow portion N1 including a front pillar B4, front door D1 and hinge H1, FIG. 2E is a cross-sectional view along line 2E-2E of FIG. 2A, that is, a cross-sectional view illustrating an example of a narrow portion N2 including a center pillar B5, rear door D2 and hinge H2, FIG. 2F is an exploded perspective view illustrating an example of the hinges H1 and H2 of FIG. 2B and FIG. 2C, and FIG. 2G is a view of a state in which the front door D1 of the vehicle body B according to one or more embodiments of the present invention is opened, when viewed from behind the main shell body.

As illustrated in FIG. 2A, the vehicle body B according to one or more embodiments of the present invention comprises a main shell body B1 and lid parts that include a hood F, front doors D1, rear doors D2 and a trunk lid T. Both side surfaces of the main shell body B1 are each formed with a front door opening part B2 and a rear door opening part B3. The front door opening part B2 is an opening that is defined by a front pillar B4, center pillar B5, roof side rail B8 and side sill B9 of the main shell body B1. The rear door opening part B3 is an opening that is defined by a center pillar B5, rear pillar B10, roof side rail B8 and side sill B9 of the main shell body B1. Hereinafter, the front door opening part B2 and the rear door opening part B3 are referred also to as "door opening parts B2 and B3" in a collective term. The trunk lid T illustrated as a lid part may be a back door depending on the vehicle type of the vehicle body B.

The vehicle body B according to one or more embodiments of the present invention is the vehicle type of a four-door sedan, as illustrated, and the side doors D at each side are therefore provided as a front door D1 and a rear door D2. In the case of a two-door sedan or a two-door coupe, each side has a front door D1 and a front door opening part B2 and does not have a rear door D2 and a rear door opening part B3. In one or more embodiments of the present invention, the front door D1 is arranged to correspond to the front door opening part B2 and the rear door D2 is arranged to correspond to the rear door opening part B3. In this case, the side doors D, which include the front doors D1 and the rear doors D2, correspond to an example of the side doors according to the present invention. In the cases of the above-described two-door sedan and two-door coupe, the front doors D1 correspond to an example of the side doors according to the present invention.

Figure 2B:
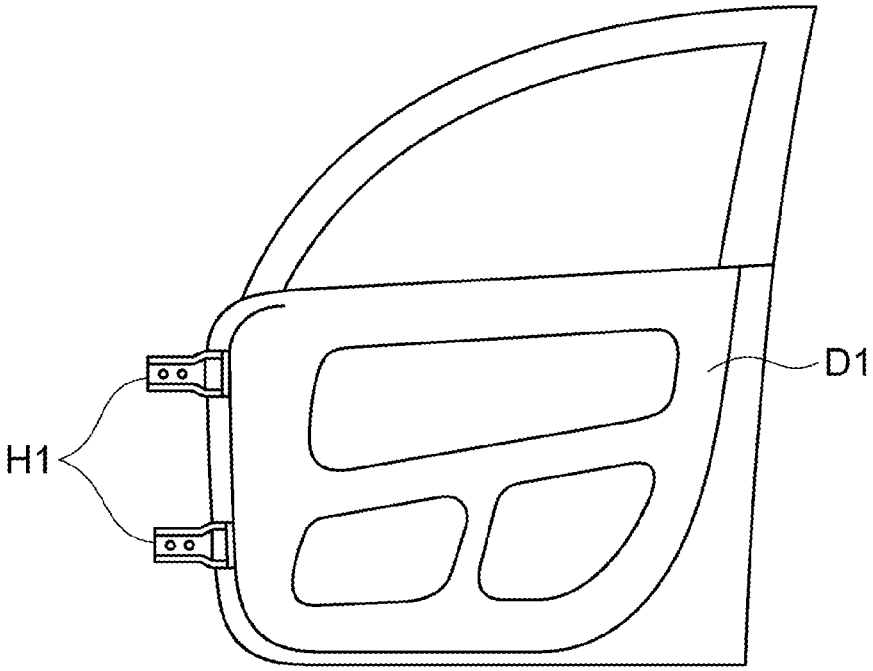
FIG. 2B is a front elevational view of a front door of a vehicle body according to one or more embodiments of the present invention when viewed from the interior side.
Figure 2C:
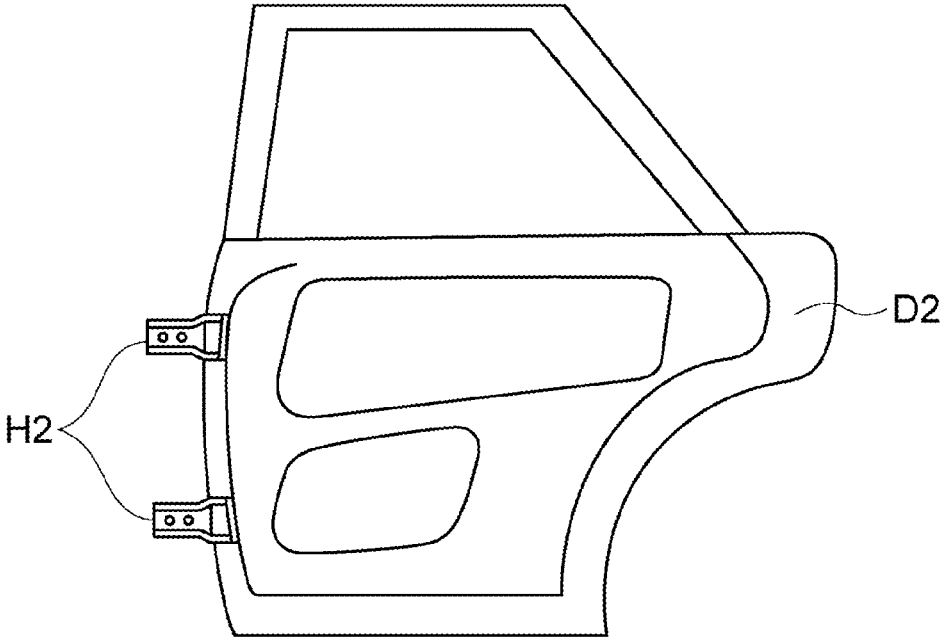
FIG. 2C is a front elevational view of a rear door of a vehicle body according to one or more embodiments of the present invention when viewed from the interior side.
Figure 2D:
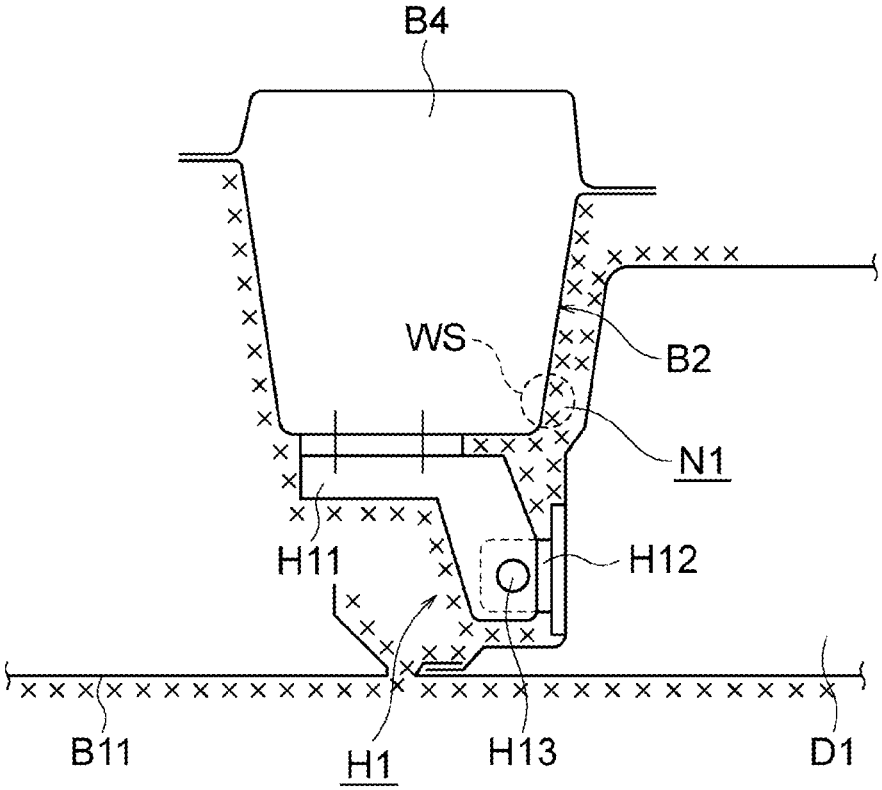
FIG. 2D is a cross-sectional view along line 2D-2D of FIG. 2A, that is, a cross-sectional view illustrating an example of a narrow portion including a front pillar, front door and hinge.
Figure 2E:
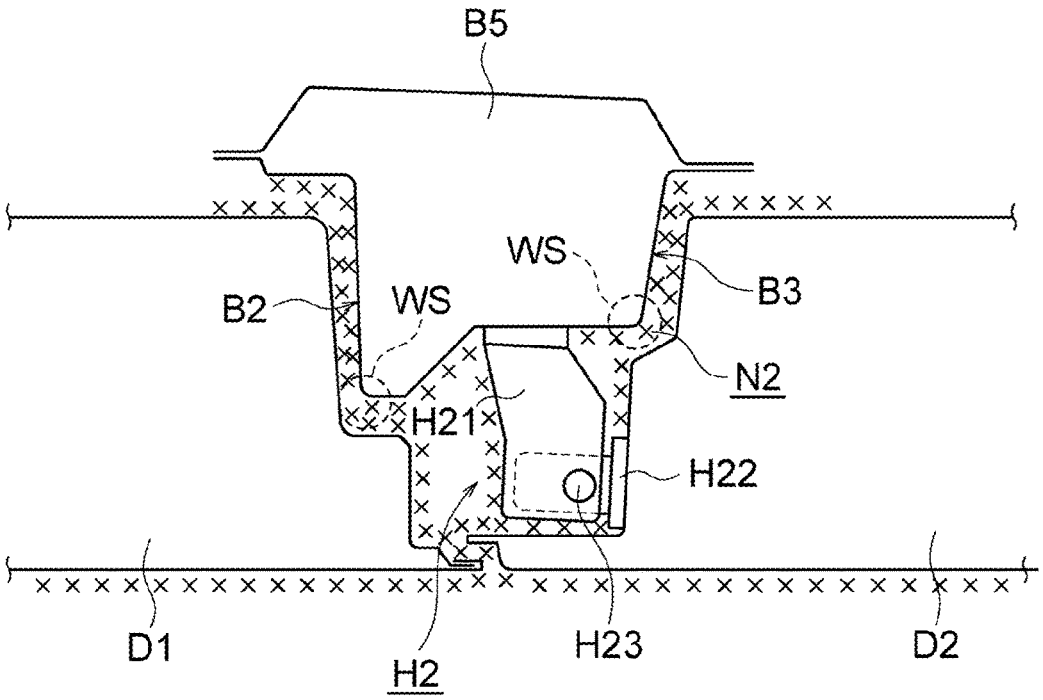
FIG. 2E is a cross-sectional view along line 2E-2E of FIG. 2A, that is, a cross-sectional view illustrating an example of a narrow portion including a center pillar, rear door and hinge.
Figure 2F:
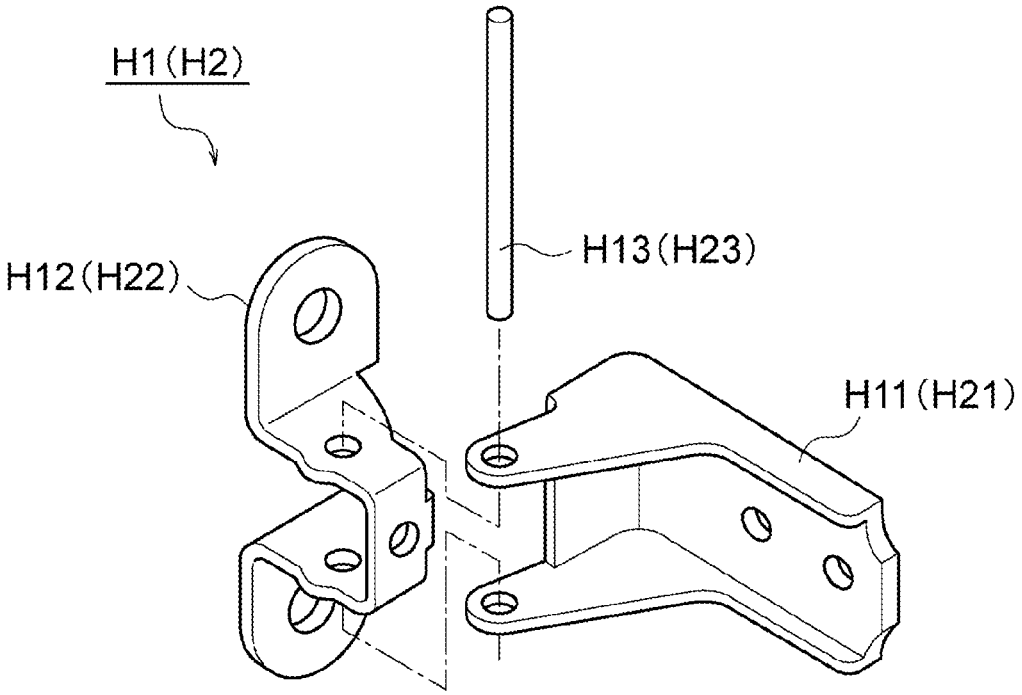
FIG. 2F is an exploded perspective view illustrating an example of hinges of FIG. 2B and FIG. 2C.
Figure 2G:
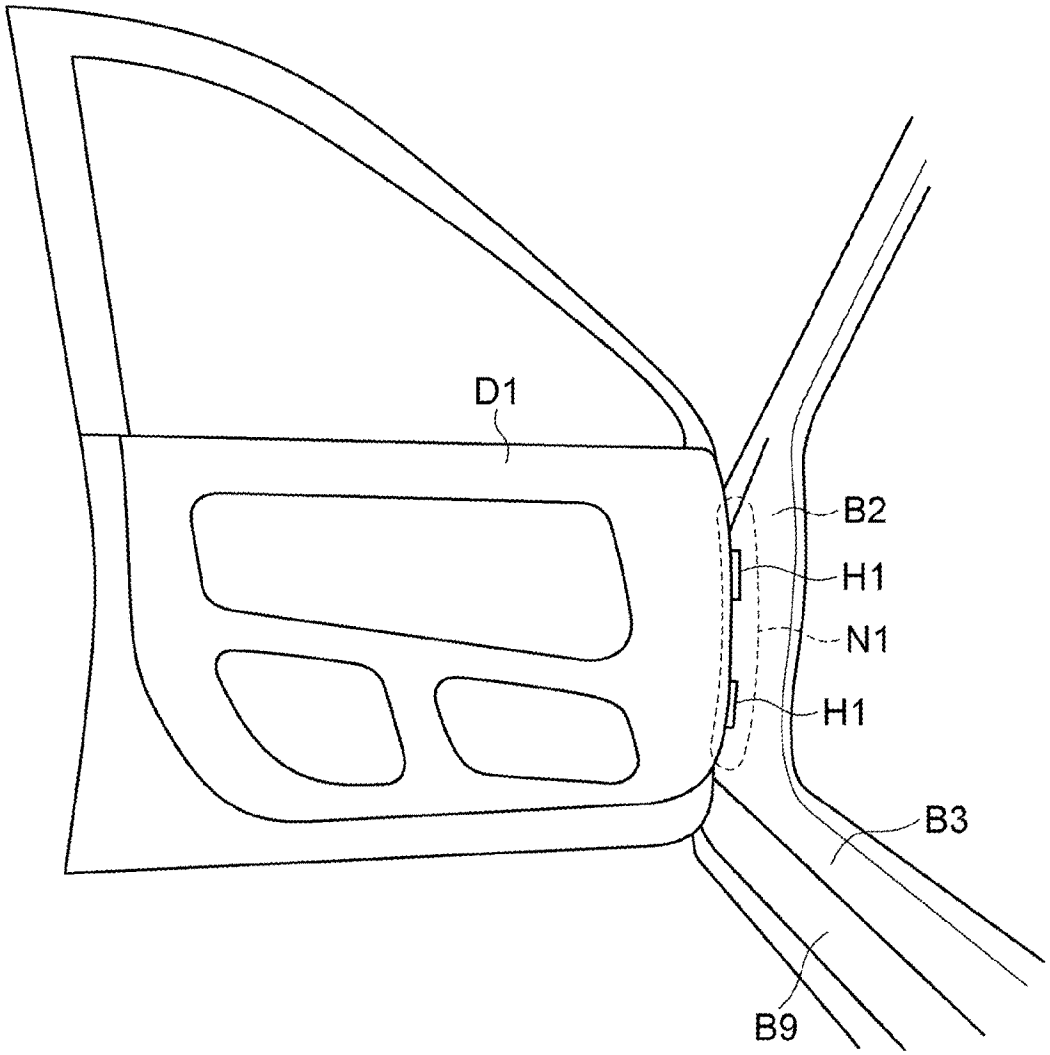
FIG. 2G is a view of a state in which the front door of a vehicle body according to one or more embodiments of the present invention is opened, when viewed from behind a main shell body.

As illustrated in FIG. 2B and FIG. 2D, the front door D1 is provided with two hinges H1 at upper and lower positions of the front edge of the front door D1 (front side of the vehicle body B). As illustrated in FIG. 2C and FIG. 2E, the rear door D2 is provided with two hinges H2 at upper and lower positions of the front edge of the rear door D2 (front side of the vehicle body B). The hinges H1 and H2, which are for attaching the front doors D1 and the rear doors D2 to the main shell body B1 in an openable and closable manner, are different in shapes to some degree, but the basic structure is the same. One of the hinges H1 is therefore illustrated in FIG. 2F and illustration of the hinges H2 is omitted by denoting the corresponding reference numerals in parentheses.

As illustrated in FIG. 2F, the hinge H1 has two hinge brackets H11 and H12 and a hinge pin H13. The hinge bracket H12 is attached to the inner panel of the front door D1 via bolts (not illustrated) while the hinge bracket H11 is attached to the front pillar B4 of the main shell body B1 via bolts (not illustrated). The hinge pin H13 is inserted in four holes of the two hinge brackets H11 and H12 and fixed by means of swaging or press fitting. This allows the hinge brackets H11 and H12 to be coupled with each other in a rotatable manner around the hinge pin H13.

In the shell body assembly process line WL, a subassembly of each hinge H1 is preliminarily assembled such that the hinge pin H13 is inserted in four holes of the two hinge brackets H11 and H12 and fixed by means of swaging or press fitting, and the subassembly is carried into the final process. Before the front door D1 is attached to the main shell body B1, one hinge bracket H11 of the subassembly of each hinge H1 is bolted to the front door D1, which is then positioned with respect to the front door opening part B2 of the main shell body B1 using a jig and the like, and the other hinge bracket H12 is bolted to the front pillar B4. This allows the front door D1 to move pivotally about the hinge pins H13 and the front door D1 can thus be opened and closed.

Similarly, the hinge H2 has two hinge brackets H21 and H22 and a hinge pin H23 as denoted by reference numerals in parentheses of FIG. 2F. The hinge bracket H21 is attached to the rear door D2 via bolts (not illustrated) while the hinge H22 is attached to the center pillar B5 of the main shell body B1 via bolts (not illustrated). The hinge pin H23 is inserted in holes of the two hinge brackets H21 and H22 and fixed by means of swaging or press fitting. This allows the hinge brackets H21 and H22 to be coupled with each other in a rotatable manner around the hinge pin H23. That is, the rear door D2 can move pivotally about the hinge pins H23 thereby to be openable and closable. Hereinafter, the hinges H1 and H2 will be referred to as "hinges H" in a collective term.

As illustrated in FIG. 2D, FIG. 2E and FIG. 2G, the vehicle body B according to one or more embodiments of the present invention is formed with narrow portions N1 and N2 with a small space between the main shell body B1 and the side doors D. Specifically, as illustrated in FIG. 2D and FIG. 2G, the narrow portion N1 with a small space is formed in the vicinities of the front pillar B4 of the main shell body B1 and the hinges H1 to the front door D1 while, as illustrated in FIG. 2E, the narrow portion N2 with a small space is formed in the vicinities of the center pillar B5 of the main shell body B1 and the hinges H2 to the rear door D2. In particular, hot air from the paint baking oven 1 cannot readily get into the vicinities of the hinges H1 and H2 because they obstruct the hot air regardless of the opened or closed state of the front door D1 and the rear door D2, and the vicinities of the hinges H1 and H2 may not be readily heated due to the structural reason as compared with the body exterior parts of the vehicle body B. The vicinities of the hinges H1 and H2 are thus sites at which a predetermined temperature as the quality assurance standard for the coating film is difficult to be maintained for a predetermined time or longer. The cross marks "x" illustrated in FIG. 2D and FIG. 2E represent areas of the top coating (coated surfaces of the narrow portions) and reference characters WS represent weatherstrips to be attached to the side doors D1 and D2 for sealing between the side doors D1 and D2 and the door opening parts B2 and B3. In particular, coated areas from the weatherstrips to the exterior are sites that are severely affected by a corrosive environment and require the coating quality, such as interfacial adhesion of the coating film, in addition to the quality of appearance.

Referring again to FIG. 2A, the above-described vehicle body B is conveyed from the electrodeposition paint baking process P13 to the final inspection process P6 of FIG. 1A and FIG. 1B in a state of being loaded on the transfer trolley 50. The transfer trolley 50 according to one or more embodiments of the present invention is made as a rectangular frame body in the plan view and has a base 51 composed of a rigid body that is enough to support the vehicle body B, four wheels 54 provided at the lower surface of the base 51, and two front attachments 52 and two rear attachments 53 provided at the upper surface of the base 51. The right and left front attachments 52 support right and left front under bodies B6 (such as front side members) of the vehicle body B, respectively, and the right and left rear attachments 53 support right and left rear under bodies B7 (such as rear side members) of the vehicle body B, respectively. These four attachments 52 and 53 horizontally support the vehicle body B. The four wheels 54 rotate along rails 41 that are laid at the right and left of a conveyor 40. As described above, in one or more embodiments of the present invention, the vehicle body B may be conveyed forward or may also be conveyed backward in part or whole of the processes of the coating process line PL.

Figure 3A:
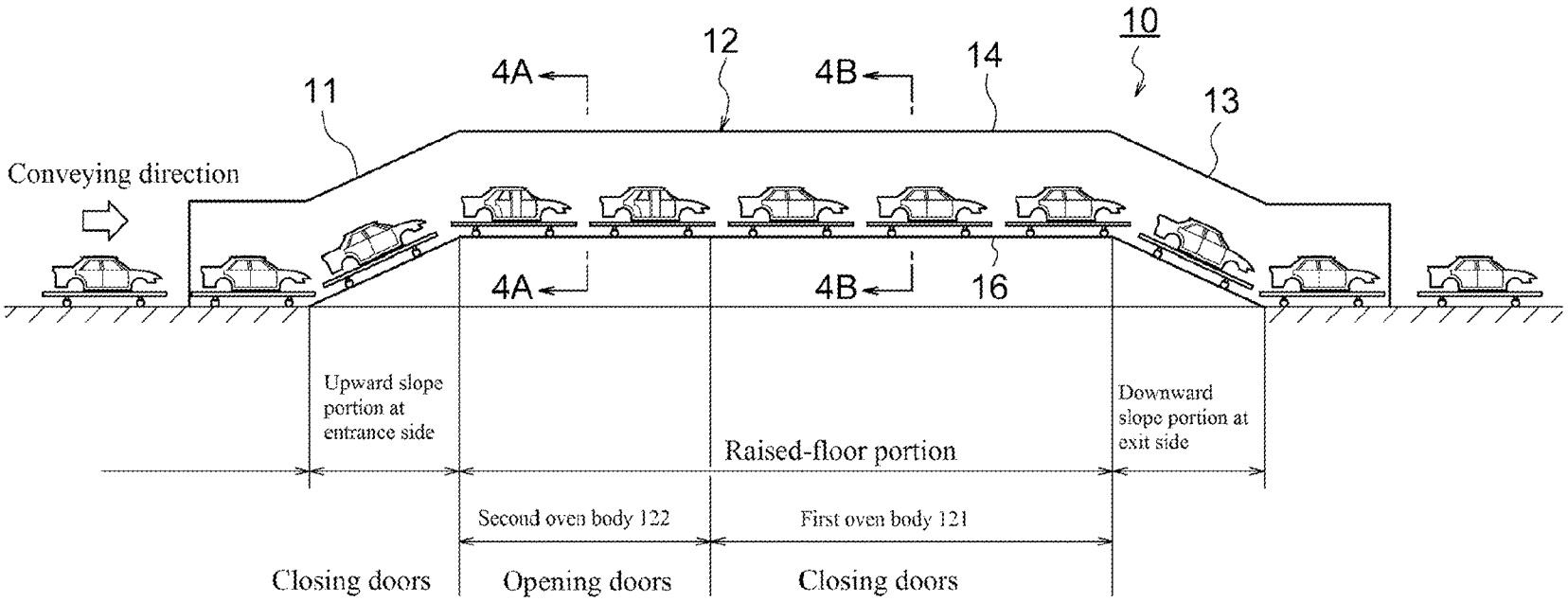
FIG. 3A is a side elevational view illustrating a schematic configuration of a topcoat paint baking oven according to one or more embodiments of the present invention.
Figure 3B:
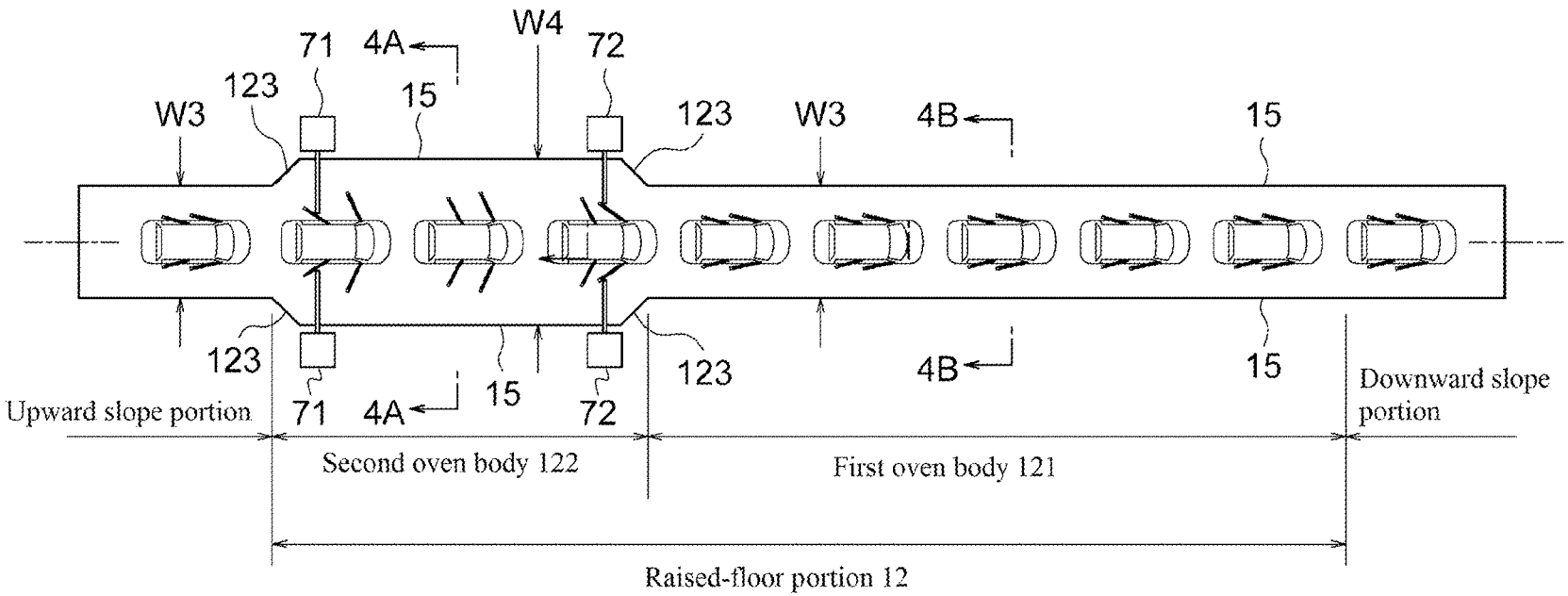
FIG. 3B is a plan view of FIG. 3A.

Next, the topcoat paint baking oven 1 according to one or more embodiments of the present invention will be described. FIG. 3A is a side elevational view illustrating a schematic configuration of the topcoat paint baking oven according to one or more embodiments of the present invention, FIG. 3B is its plan view, FIG. 4A is a cross-sectional view along line 4A-4A of FIG. 3A and FIG. 3B, and FIG. 4B is a cross-sectional view along line 4B-4B of FIG. 3A and FIG. 3B.

As illustrated in FIG. 3A, FIG. 3B, FIG. 4A and FIG. 4B, the topcoat paint baking oven 1 according to one or more embodiments of the present invention comprises an oven body 10, hot air supply device 20, and air exhauster 30. As illustrated in the side elevational view of FIG. 3A, the oven body 10 according to one or more embodiments of the present invention is a hill-shaped baking oven that includes an upward slope portion 11 at the entrance side, a downward slope portion 13 at the exit side, and a raised-floor portion 12 between the upward slope portion 11 and the downward slope portion 13. From another aspect, as illustrated in the cross-sectional views of FIG. 4A and FIG. 4B, the oven body 10 is a rectangular baking oven that has a ceiling surface 14, a pair of side wall surfaces 15 and 15 at the right and left, and a floor surface 16. In an alternative embodiment, the oven body 10 may be configured as a flat-type oven. In the side elevational view of FIG. 3A and the plan view of FIG. 3B, the left side represents a topcoat setting zone at the end of the topcoat paint coating booth and the entrance side of the oven body 10 while the right side represents the exit side of the oven body 10. The vehicle bodies B loaded on the transfer trolleys 50 are conveyed forward from the left to the right of FIG. 3A and FIG. 3B. That is, the vehicle bodies B conveyed in the topcoat paint baking oven 1 according to one or more embodiments of the present invention are conveyed leftward as illustrated in FIG. 2A.

The floor surface 16 of the raised-floor portion 12 of the oven body 10 has approximately the same height as that of an opening upper end edge of the entrance of the oven body 10 and that of an opening upper end edge of the exit of the oven body 10. Owing to this structure, the hot air supplied into the raised-floor portion 12 can be suppressed from escaping to external of the oven body 10 via the entrance or exit. On the floor surface 16 of the oven body 10, the conveyor 40 is laid along the extending direction of the oven body 10. The conveyor 40 conveys the transfer trolleys 50 on which the vehicle bodies B are loaded.

Figure 4A:
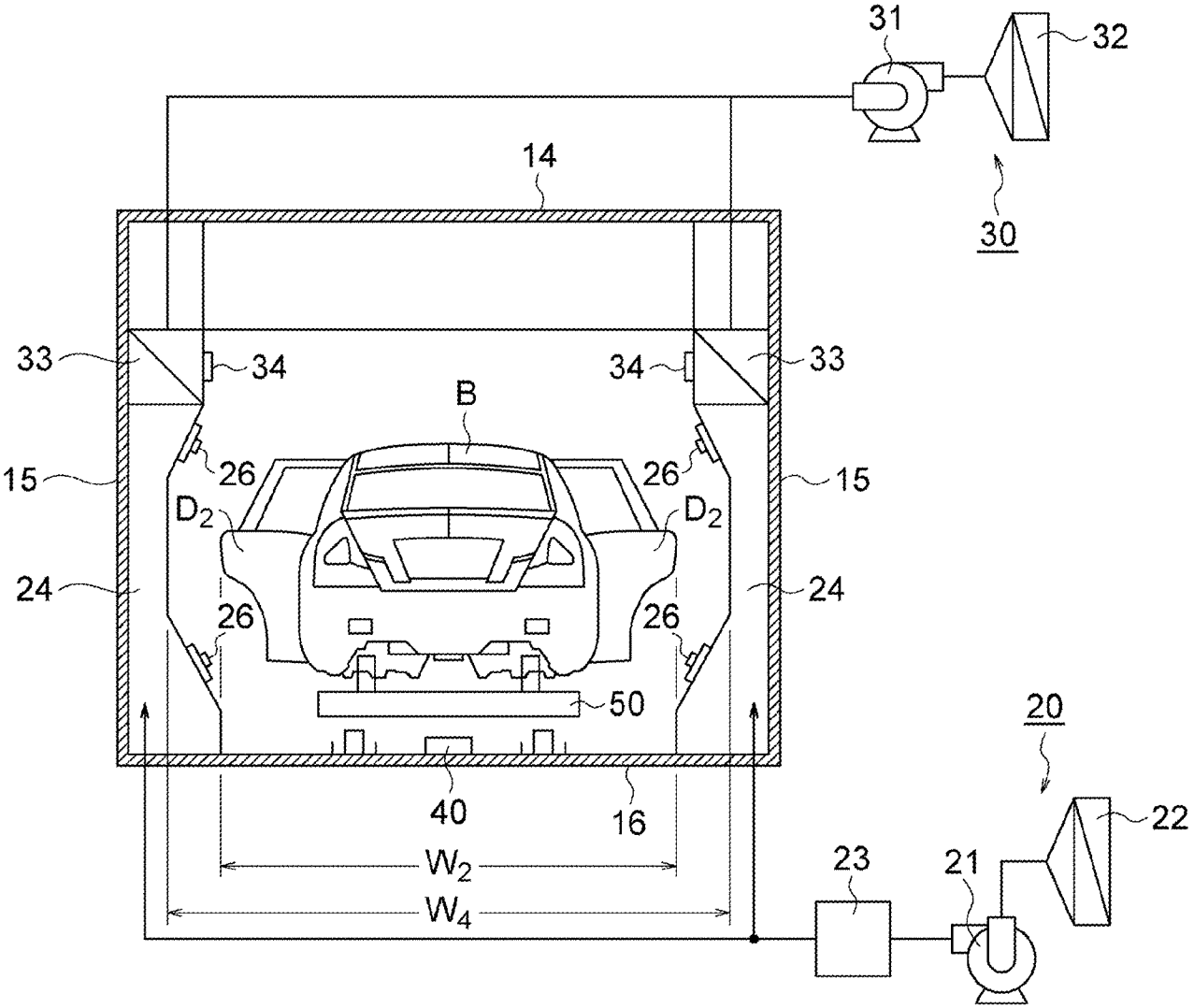
FIG. 4A is a cross-sectional view along line 4A-4A of FIG. 3A and FIG. 3B.
Figure 4B:
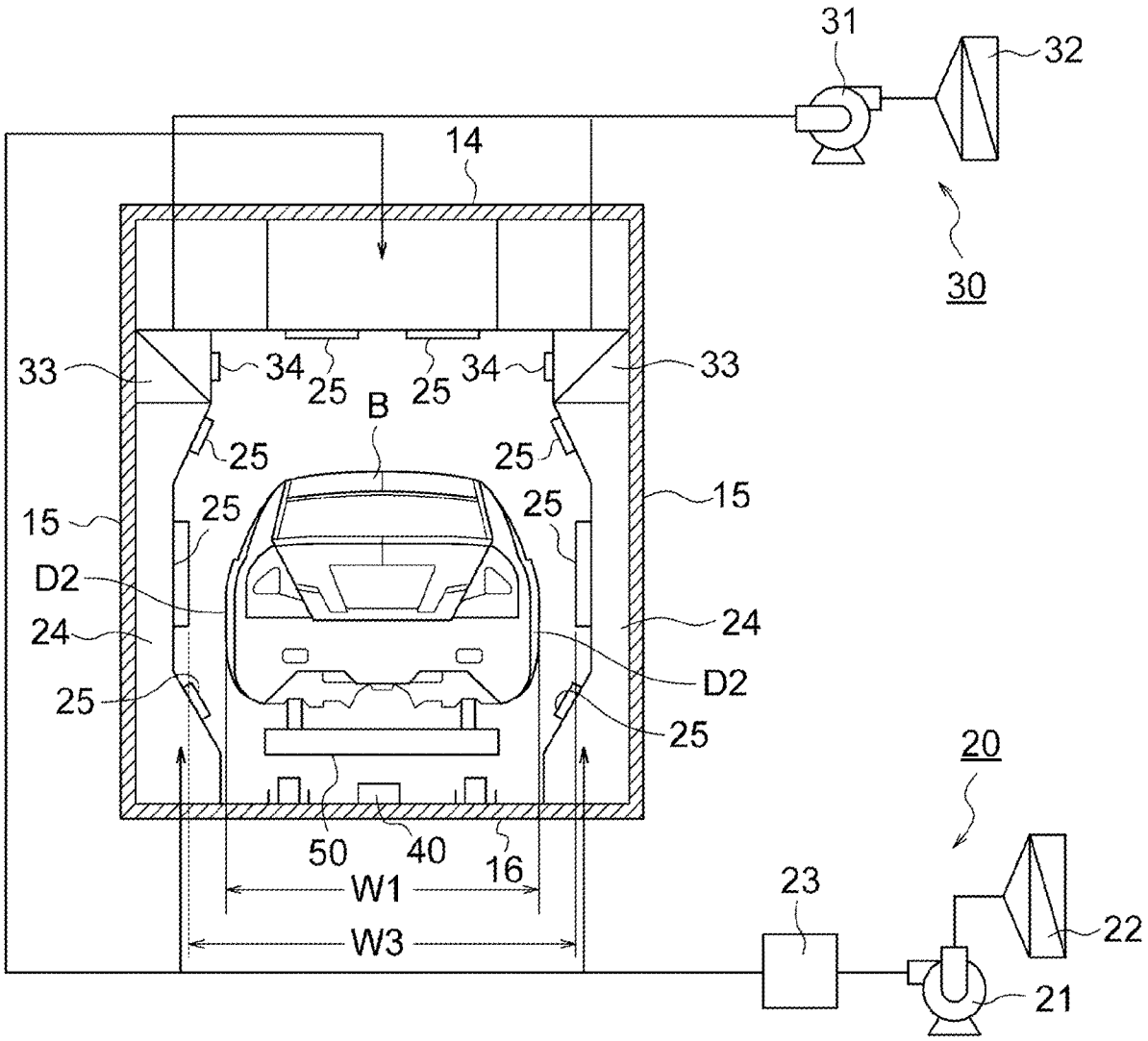
FIG. 4B is a cross-sectional view along line 4B-4B of FIG. 3A and FIG. 3B.

The hot air supply device 20 is equipment for supplying the generated hot air into the raised-floor portion 12 of the oven body 10 and, as illustrated in FIG. 4A and FIG. 4B, comprises an air supply fan 21, air supply filter 22, burner 23, air supply ducts 24, first hot air blowoff ports 25, and second hot air blowoff ports 26. The air supply fan 21 is equipment for supplying the intake air from external into the raised-floor portion 12 of the oven body 10. The air supply filter 22, which is connected to the intake side of the air supply fan 21, filters the intake air from external to separate dust and the like. This allows the air supply fan 21 to suck clean air. The burner 23, which is connected to the discharge side of the air supply fan 21, heats the air discharged from the air supply fan 21 to a predetermined temperature. This allows the intake air to be supplied as blasts of hot air into the raised-floor portion 12 of the oven body 10.

As illustrated in FIG. 4A and FIG. 4B, the air supply ducts 24 are arranged along the conveying direction of the vehicle bodies B at the ceiling surface 14 and right and left side wall surfaces 15 and 15 of the oven body 10. In one or more embodiments of the present invention, the raised-floor portion 12 is a substantial heating region. As illustrated in FIG. 3A and FIG. 3B, the raised-floor portion 12, which is the substantial heating region of the topcoat paint baking oven 1, is composed of a first oven body 121 provided at the downstream side and a second oven body 122, also referred to as a spot baking region, provided at the upstream side. The first oven body 121 has a side-to-side width W3 corresponding to a body width W1 of the vehicle body B in a state in which the front doors D1 and the rear doors D2 are closed (in a strict sense, a state in which the doors have a small opening degree to such an extent that the door inners and door sashes are not in contact with the door opening parts B2 and B3). On the other hand, the second oven body 122 has a side-to-side width W4 corresponding to a body width W2 of the vehicle body B in a state in which the front doors D1 and the rear doors D2 are opened (a state in which the doors are fully opened or have an opening degree close to the fully-opened state). The side-to-side width W4 is wider than the side-to-side width W3 of the first oven body 121 (W3<W4). As used herein, the side-to-side width of the first oven body 121 and second oven body 122 means a distance between the insides of the opposing side wall surfaces 15 and 15, that is, a width dimension having a space to such an extent that the vehicle body B is not interfered.

As illustrated in the plan view of FIG. 3B, in the raised-floor portion 12 according to one or more embodiments of the present invention, the side surfaces connecting between the end parts of the side wall surfaces 15 of the first oven body 121 and the end parts of the side wall surfaces 15 of the second oven body 122 are provided as slant wall surfaces 123 that have decreasing dimensions from the second oven body 122 toward the first oven body 121. This promotes smooth flow of the hot air through the connecting portion between the first oven body 121 and the second oven body 122 and can prevent the hot air from staying there. As illustrated in FIG. 3B, the side surfaces connecting between the end parts of the side wall surfaces 15 of the second oven body 122 and the end parts of side wall surfaces of the upward slope portion 11 at the entrance side are also provided as slant wall surfaces 123 that have decreasing dimensions from the second oven body 122 toward the upward slope portion 11, but this may be omitted as necessary.

The raised-floor portion 12 according to one or more embodiments of the present invention constitutes a substantial heating region. As illustrated in FIG. 3A and FIG. 3B, the second oven body 122 constitutes a substantial temperature rising region that primarily raises the temperature of coated surfaces of the narrow portions N1 and N2 of the vehicle body B, and the subsequent first oven body 121 constitutes an exterior temperature rising and temperature maintaining region that raises the temperature of the body exterior parts of the vehicle body B and maintains the temperature of the whole vehicle body B. For these reasons, the second oven body 122 is provided with the second hot air blowoff ports 26 as illustrated in FIG. 4A while the first oven body 121 is provided with the first hot air blowoff ports 25 as illustrated in FIG. 4B. In an alternative embodiment, air supply ducts 24 of the second oven body 122, which is provided with the second hot air blowoff ports 26 as illustrated in FIG. 4A, and air supply ducts 24 of the first oven body 121, which is provided with the first hot air blowoff ports 25 as illustrated in FIG. 4B, may be insulated from each other and the air supply fan 21, air supply filter 22 and burner 23 may be provided for each insulated region so as to control the temperature and flow rate of the hot air to be supplied to the insulated regions.

The first hot air blowoff ports 25 illustrated in FIG. 4B are composed of a plurality of rectangular slits (openings) that are formed at predetermined intervals along the extending direction of the air supply ducts 24 arranged in the raised-floor portion 12 of the oven body 10 and wind direction plates that may be provided at the slits as necessary. The first hot air blowoff ports 25 are provided such that respective openings of the slits or respective wind direction plates are directed to a middle part of the oven body 10, that is, to the vehicle body B. The first hot air blowoff ports 25 are thus arranged such that, when the vehicle body B passes in front of the first hot air blowoff ports 25, the openings or wind direction plates are oriented toward the body exterior parts, such as front fenders B11, side doors D, side sills B9 and rear fenders B12, of the vehicle body B. The first hot air blowoff ports 25 provided at the ceiling surface 14 are arranged such that, when the vehicle body B passes in front of the first hot air blowoff ports 25, the openings or wind direction plates are oriented toward the body exterior parts, such as a hood F, roof B13 and trunk lid T, of the vehicle body B. The first hot air blowoff ports 25 configured as the above blow the hot air to the whole vehicle body B to raise and maintain the temperature of the whole vehicle body B including the body exterior parts.

In contrast, the second hot air blowoff ports 26 provided in the second oven body 122 are disposed, as illustrated in FIG. 4A, at upper parts and lower parts of the air supply ducts 24 and 24 of the right and left side wall surfaces 15 and 15 of the second oven body 122. The front of each second hot air blowoff port 26 is configured to include guide parts that are one type of wind direction plates, and the second hot air blowoff ports 26 provided at the upper side are opened toward the upstream side and obliquely downward while the second hot air blowoff ports 26 provided at the lower side are opened toward the upstream side and obliquely upward. Consequently, these second hot air blowoff ports 26 are provided such that, when the vehicle body B passes in front of the second hot air blowoff ports 26, the openings are oriented toward the coated surfaces of the narrow portions N1 and N2 in the vicinities of the hinges H which attach the side doors D to the main shell body B1.

Thus, the second hot air blowoff ports 26 are opened toward the upstream side. In the second oven body 122, therefore, the hot air can readily be blown toward the vicinities of the hinges H of the vehicle body B which is conveyed in a state in which the side doors D are opened. In addition, since the second hot air blowoff ports 26 are provided at the upper parts and lower parts of the side wall surfaces 15 and 15, the hot air from the second hot air blowoff ports 26 provided at the upper parts is blown mainly to the upper side of the vicinities of the hinges H while the hot air from the second hot air blowoff ports 26 provided at the lower parts is blown mainly to the lower side of the vicinities of the hinges H. The coated surfaces of the narrow portions N1 and N2 in the vicinities of the hinges H can thereby be uniformly baked.

In the second oven body 122 of the raised-floor portion 12 according to one or more embodiments of the present invention, it is preferred to provide the air supply ducts 24 and 24 of the ceiling surface 14 and side wall surfaces 15 only with the second hot air blowoff ports 26 which blow the hot air toward the vicinities of the hinges H of the vehicle body B. This can not only locally raise the temperature of the narrow portions N1 and N2 in the vicinities of the hinges H but also prevent the dust around the narrow portions N1 and N2 from attaching to the body exterior parts of the vehicle body B.

Figure 4C:
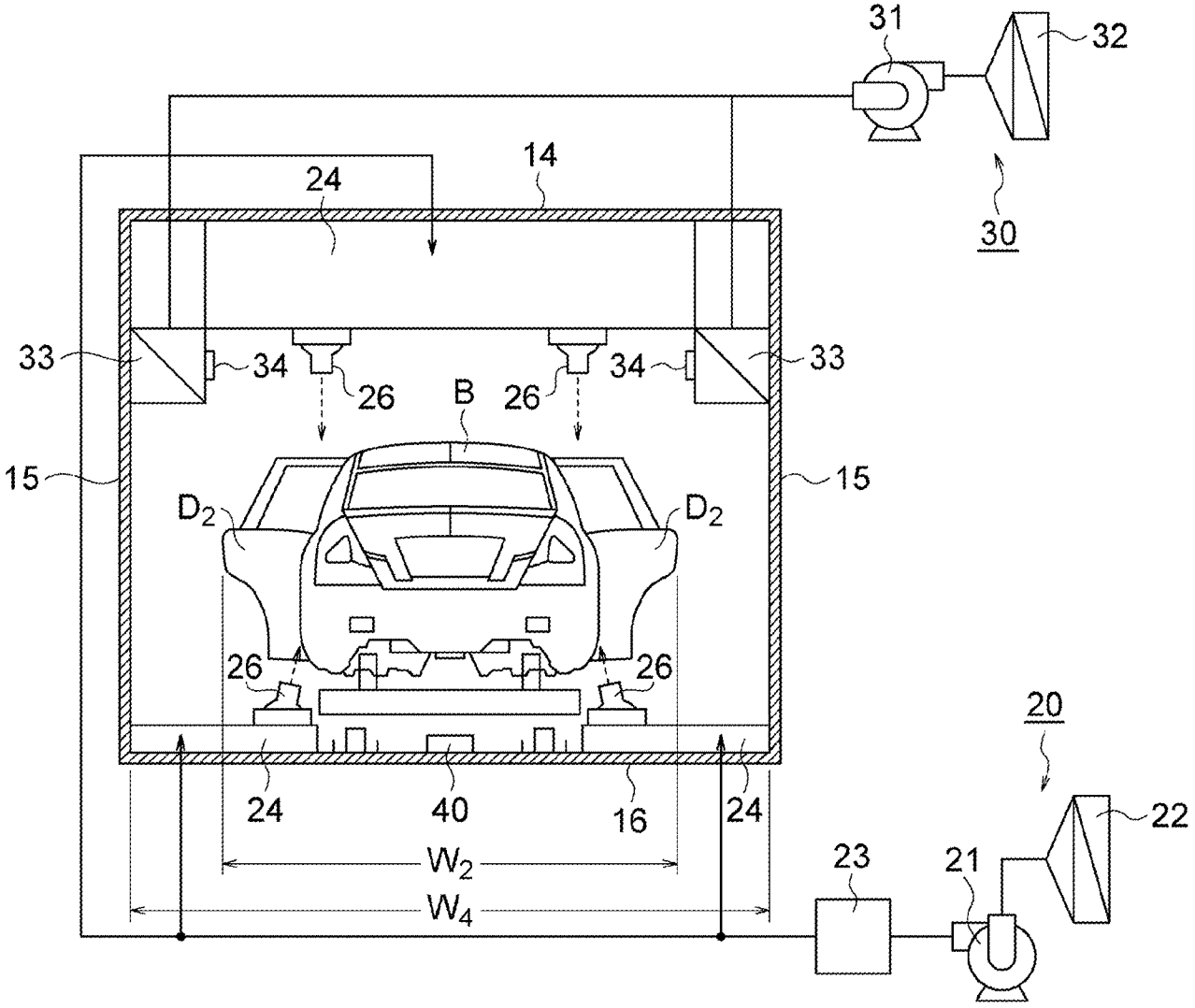
FIG. 4C is a cross-sectional view illustrating another example of second hot air blowoff ports of FIG. 4A, that is, a cross-sectional view along line 4A-4A of FIG. 3A and FIG. 3B.

In one or more embodiments of the present invention, the second hot air blowoff ports 26 are provided, as illustrated in FIG. 4A, at upper parts and lower parts of the air supply ducts 24 and 24 of the right and left side wall surfaces 15 and 15 of the second oven body 122. In an alternative embodiment, as illustrated in FIG. 4C, the ceiling surface 14 and floor surface 16 of the second oven body 122 may be provided with the air supply ducts 24 and 24 and the second hot air blowoff ports 26 may be disposed at these air supply ducts 24 and 24. A configuration for making variable the blowing direction of the hot air from the second hot air blowoff ports 26 and its control will be described later.

Although not particularly limited, in the first oven body 121 and the second oven body 122, the heat quantity of the hot air blown from the second hot air blowoff ports 26 is preferably set larger than the heat quantity of the hot air blown from the first hot air blowoff ports 25. In one or more embodiments of the present invention, the wind speed of the hot air blown from the second hot air blowoff ports 26 is made larger than the wind speed of the hot air blown from the first hot air blowoff ports 25 thereby to set larger the heat quantity of the hot air blown from the second hot air blowoff ports 26. Specifically, it is preferred that the wind speed of the hot air blown from the first hot air blowoff ports 25 illustrated in FIG. 4B be about 3 m/s in the vicinities of the coated surfaces of the body exterior parts of the vehicle body B while the wind speed of the hot air blown from the second hot air blowoff ports 26 illustrated in FIG. 4A and FIG. 4C be set at about 10 m/s.

The air exhauster 30 is equipment for exhausting the evaporated solvent in the oven body 10 to external of the system, as illustrated in FIG. 4A or FIG. 4C and FIG. 4B, and comprises an air exhaust fan 31, air exhaust filter 32, air exhaust ducts 33, and air intake ports 34. The air exhaust fan 31 is a device that sucks the hot air in the oven body 10 and exhausts the hot air to external of the system or circulates the hot air to the primary side of the hot air supply device 20, and functions to remove dust and the like and regulate the pressure of the hot air in the oven body 10. The air exhaust filter 32 is provided at the discharge side of the air exhaust fan 31. The hot air is sucked by the air exhaust fan 31 and passes through the air exhaust filter 32 to be exhausted to external of the system or returned to the hot air supply device 20. The air exhaust ducts 33 are provided along the conveying direction of the vehicle body B at the right and left side wall surfaces 15 and 15 of the oven body 10. The air intake ports 34 are composed of slits that are formed at predetermined intervals on the air exhaust ducts 33 disposed in the oven body 10.

Figure 4D:
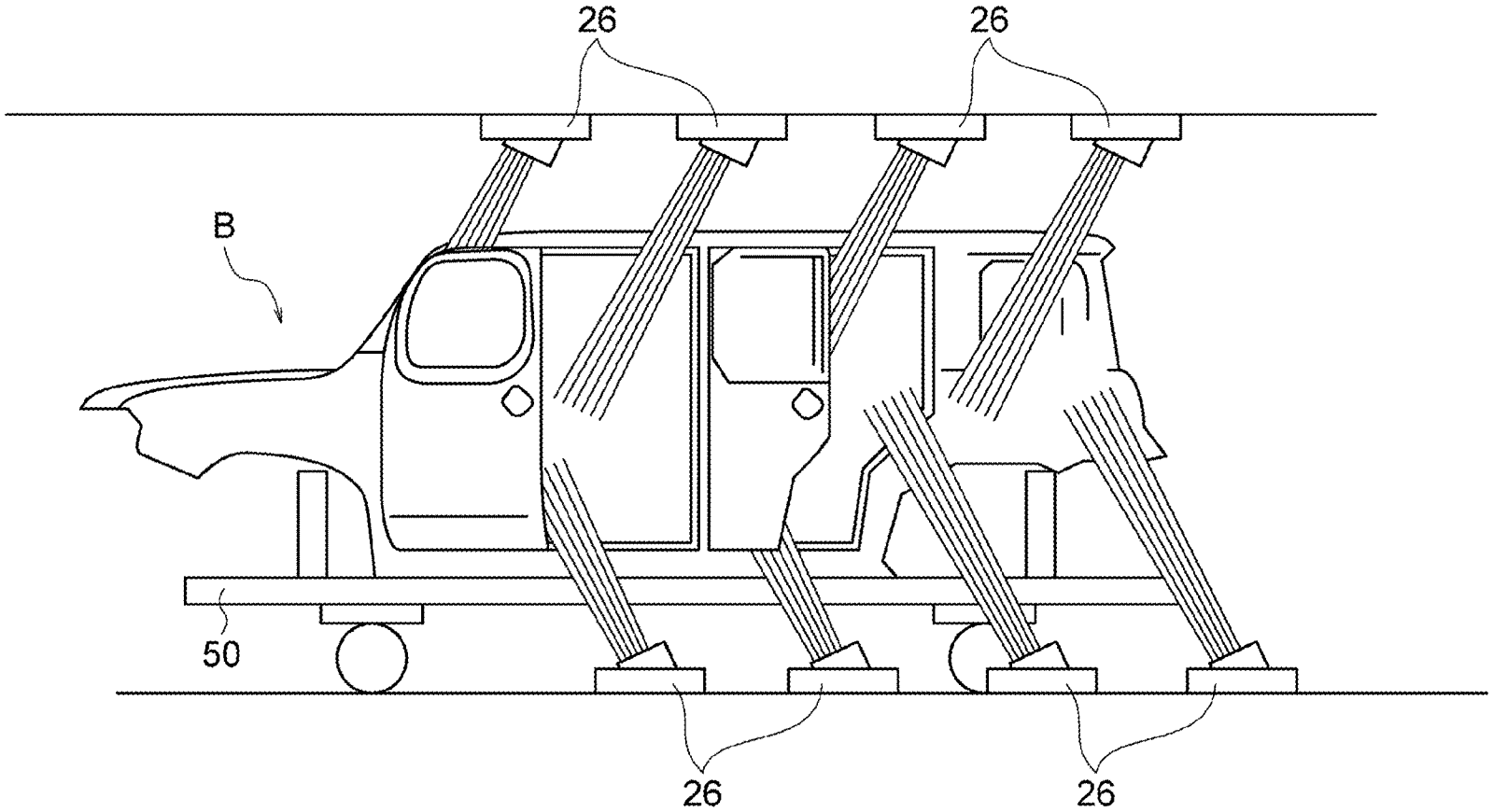
FIG. 4D is a side elevational view illustrating the blowing direction of hot air from second hot air blowoff ports in a second oven body of FIG. 3A and FIG. 3B.
Figure 4E:
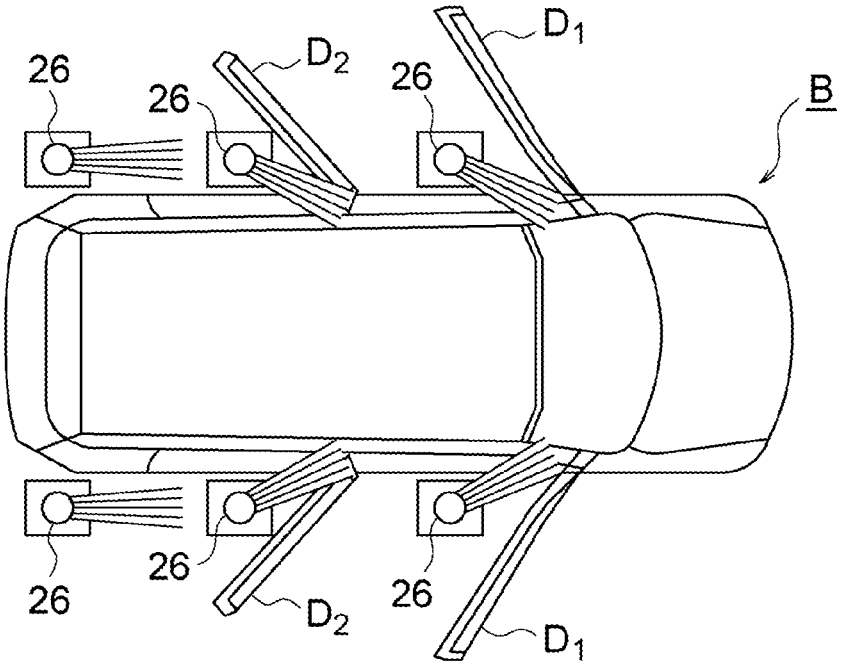
FIG. 4E is a plan view illustrating the blowing direction of hot air from second hot air blowoff ports in the second oven body of FIG. 3A and FIG. 3B.
Figure 4F:
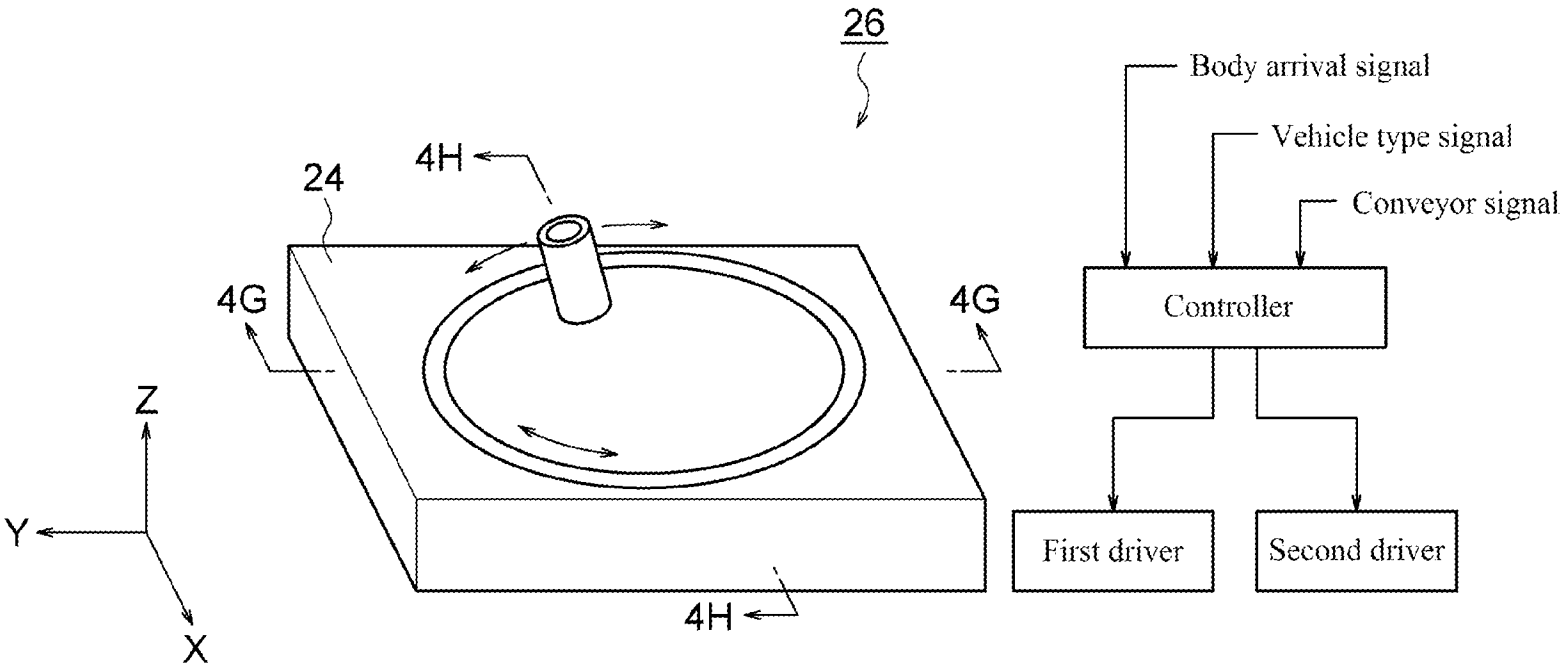
FIG. 4F is a set of perspective view and block diagram illustrating an example of the second hot air blowoff port of FIG. 4A.
Figure 4G:
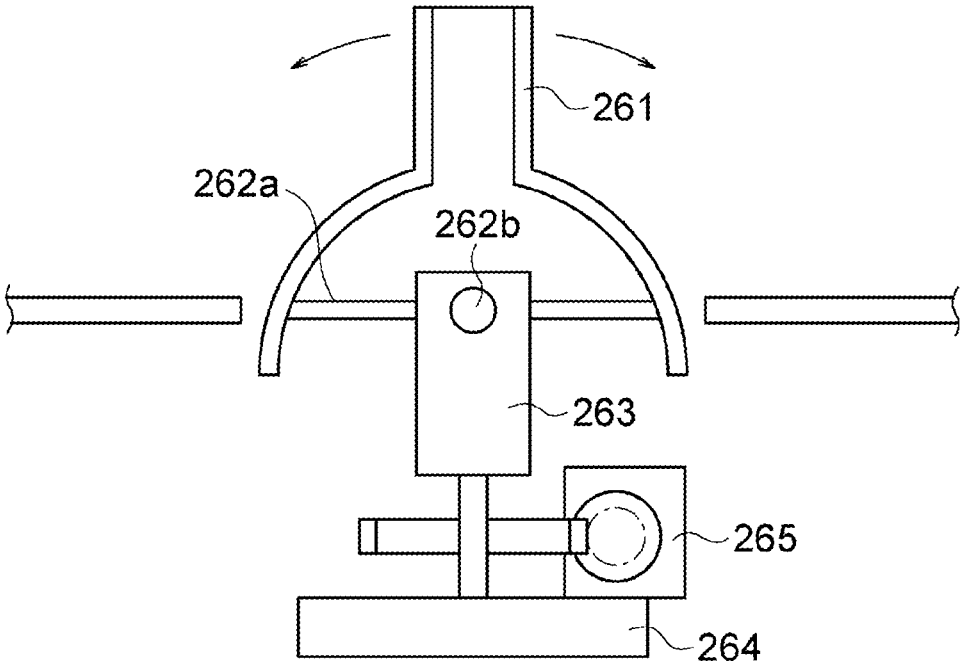
FIG. 4G is a cross-sectional view along line 4G-4G of FIG. 4F.
Figure 4H:
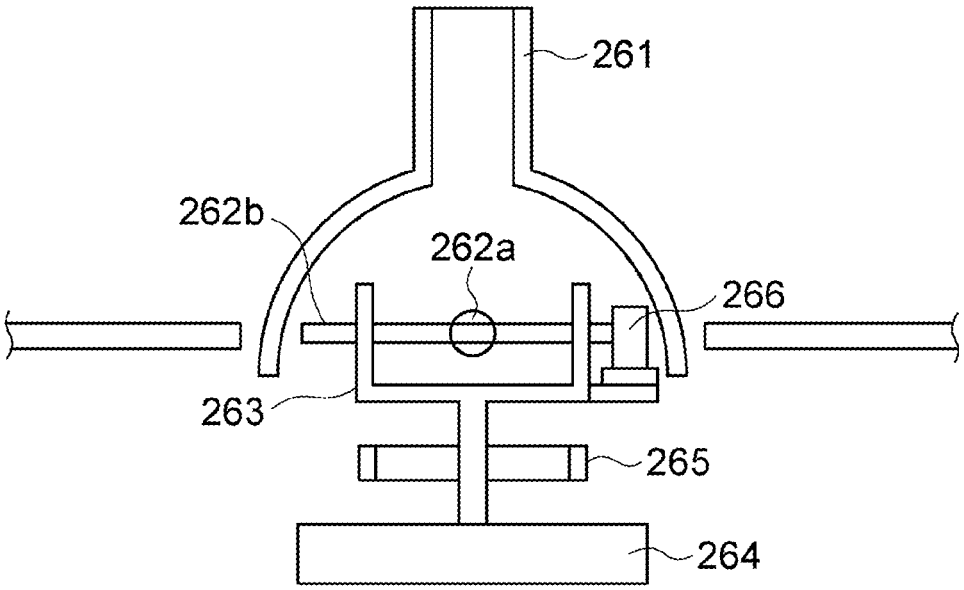
FIG. 4H is a cross-sectional view along line 4H-4H of FIG. 4F.

Next, a configuration for making variable the blowing direction of the hot air from the second hot air blowoff ports 26 according to one or more embodiments of the present invention and its control will be described. FIG. 4F is a set of perspective view and block diagram illustrating an example of the second hot air blowoff ports 26 of FIG. 4A or FIG. 4C, FIG. 4G is a cross-sectional view along line 4G-4G of FIG. 4F, and FIG. 4H is a cross-sectional view along line 4H-4H of FIG. 4F. FIG. 4D is a side elevational view illustrating the blowing direction of the hot air from the second hot air blowoff ports 26 in the second oven body 122 of FIG. 3A and FIG. 3B and FIG. 4E is a plan view illustrating the blowing direction of the hot air from the second hot air blowoff ports 26 in the second oven body 122 of FIG. 3A and FIG. 3B.

As illustrated in FIG. 4F, the second hot air blowoff ports 26 according to one or more embodiments of the present invention each comprise a blowoff port 261 that blows the hot air from the air supply duct 24, a supporter 263 that supports the blowoff port 261 via a cross-shaped gimbal 262, and a base 264 that supports the blowoff port 261 and the supporter 263. The blowoff port 261 has a shape in which, as illustrated in FIG. 4G, a tubular member is provided at the middle of a semispherical member. The blowoff port 261 and the supporter 263 are provided with the cross-shaped gimbal 262, as illustrated in FIG. 4G and FIG. 4H, which has two axial bodies 262*a* and 262*b*. Both ends of one axial body 262*a* are fixed to the semispherical portion of the blowoff port 261, as illustrated in FIG. 4G, while the middle of the axial body 262*a* is fixed to the other axial body 262*b*, as illustrated in FIG. 4H. The other axial body 262*b* is supported by the supporter 263 in a rotatable manner. The base 264 is fixed with respect to the air supply duct 24 and the supporter 263 is provided to stand upright from the base 264 in a rotatable manner.

As illustrated in FIG. 4G, the second hot air blowoff ports 26 according to one or more embodiments of the present invention each has a first driver 265 that rotates the supporter 263 in the horizontal plane with respect to the base 264 and a second driver 266 that rotates the blowoff port 261 in the vertical plane with respect to the supporter 263. The first driver 265 can be composed of a transmission mechanism, such as worm wheel and worm gear, and an actuator. The second driver 266 can be composed of an actuator fixed to the supporter 263 and necessary components. The first driver 265 and the second driver 266 are operated by control signals from a controller 267, as illustrated in the right of FIG. 4F.

When the controller 267 receives a signal that indicates that a vehicle body B arrives at a predetermined position and a signal that represents the vehicle type of the vehicle body B, the controller 267 controls the first driver 265 and the second driver 266 so that the blowing direction of the blowoff port 261 is suitable for the vehicle type of the vehicle body B. For example, various types of vehicle bodies B flow in the coating process line PL according to one or more embodiments of the present invention and they are different in the body width, body height, hinge positions for side doors with respect to the transfer trolleys 50. On the other hand, each vehicle body B is equipped with a production management communicator in which various production specs for the body is written. The controller 267 therefore detects the vehicle type of each vehicle body B at the entrance of the topcoat paint baking oven 1, for example, and controls the first driver 265 and the second driver 266 to adjust the position of the blowoff port 261 so that the hot air is blown to the hinge positions which may be the narrow portions N1 and N2. Conveyor signal indicated in the right-side block diagram of FIG. 4F is an encoder signal of the floor conveyor which conveys the vehicle bodies B, and synchronization with this conveyor signal can enhance the accuracy of relative positions of the vehicle bodies B and the second hot air blowoff port 26. The embodiment of the second hot air blowoff port 26 illustrated in FIG. 4F to FIG. 4H is merely an example of the spot blowoff port according to the present invention and it suffices that the spot blowoff port has a configuration that can vary the blowing direction of the hot air in accordance with the vehicle type.

Figure 5A:
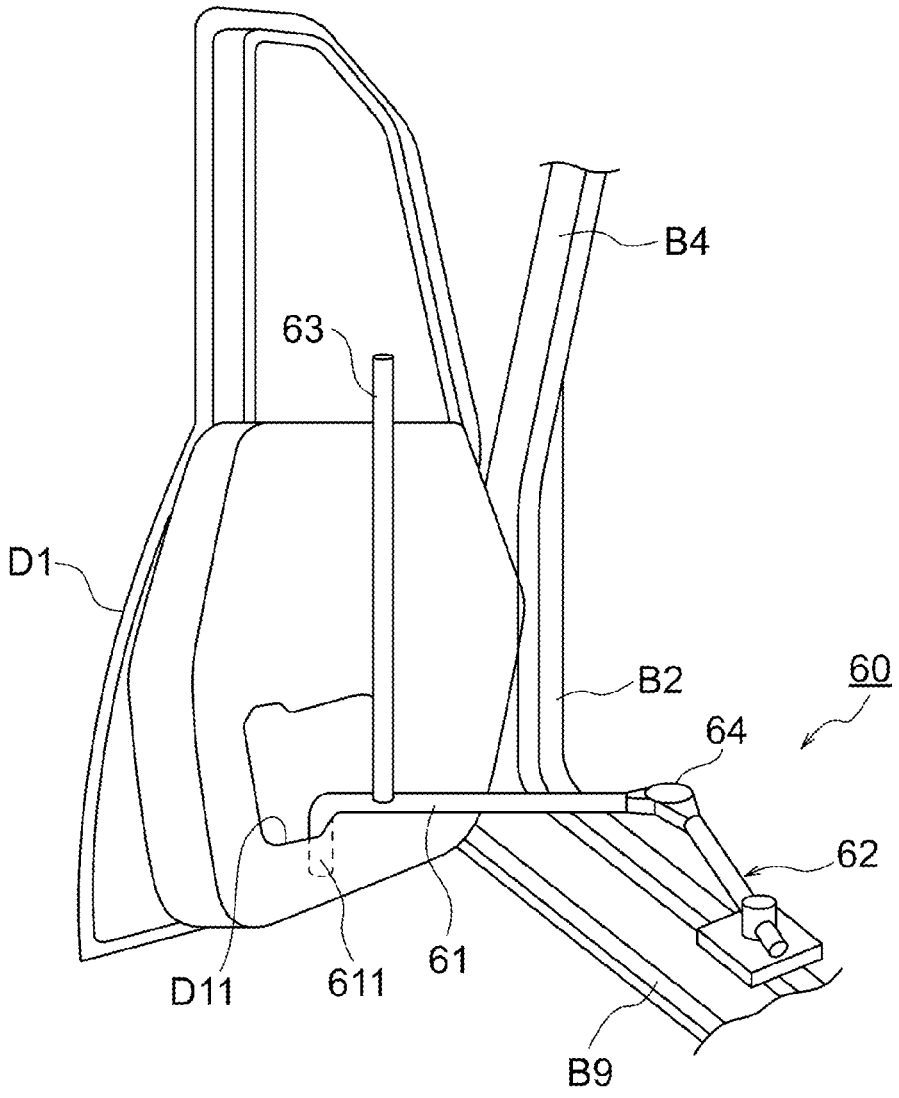
FIG. 5A is a perspective view illustrating an example of a door open/close keeping member used in a topcoat paint baking oven according to one or more embodiments of the present invention.
Figure 5B:
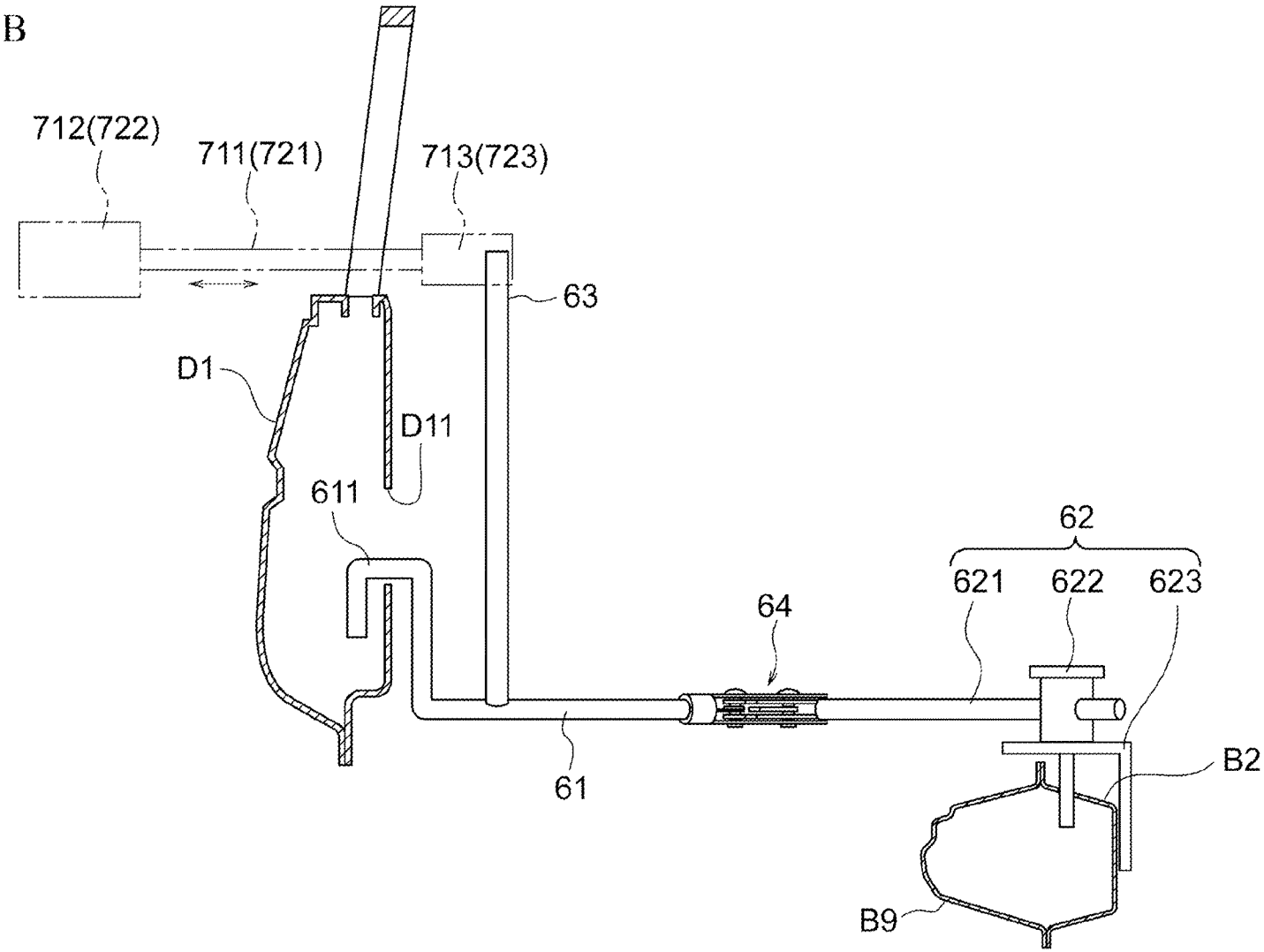
FIG. 5B is a back view of FIG. 5A.
Figure 5C:
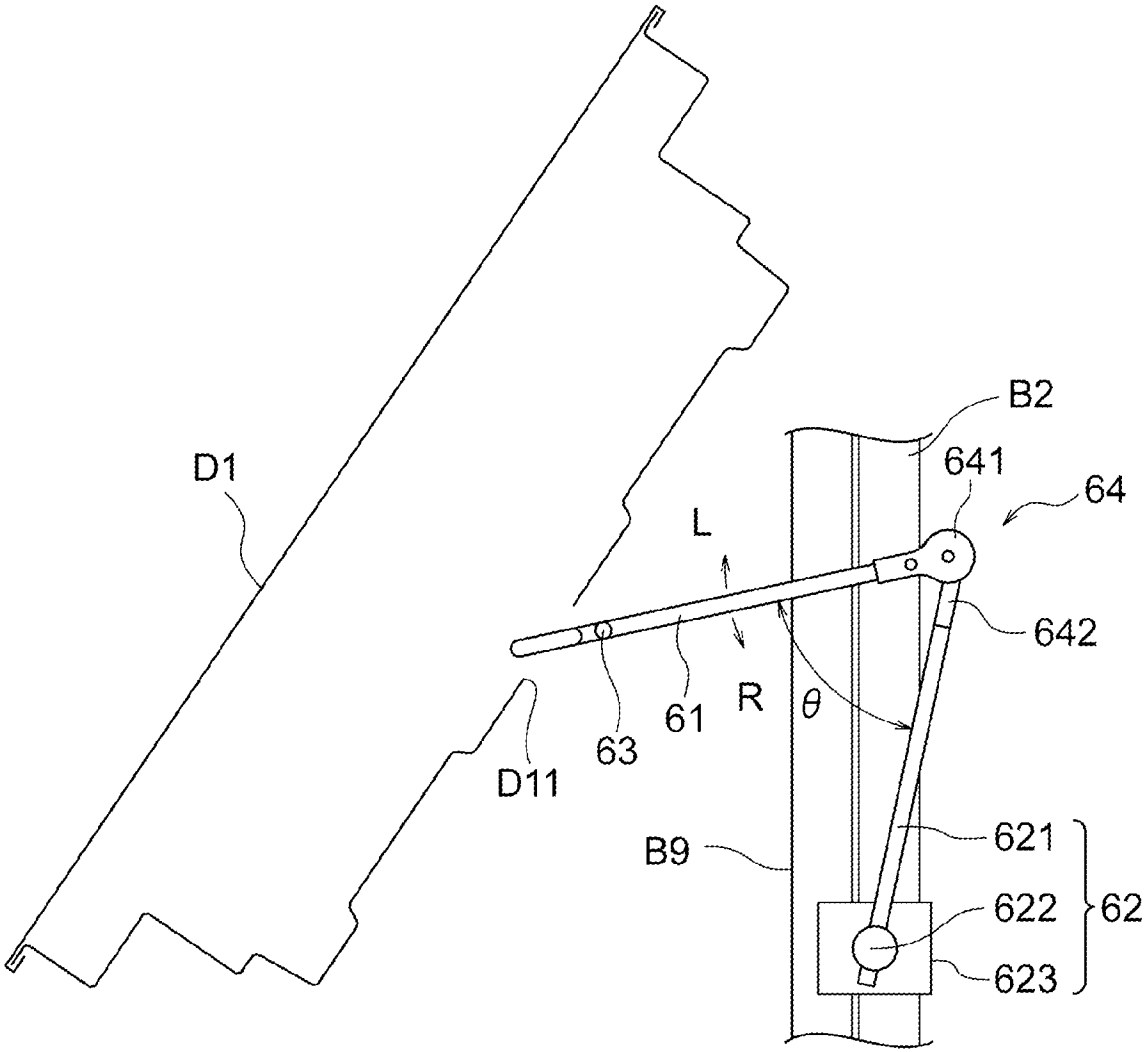
FIG. 5C is a plan view of FIG. 5A.
Figure 5D:
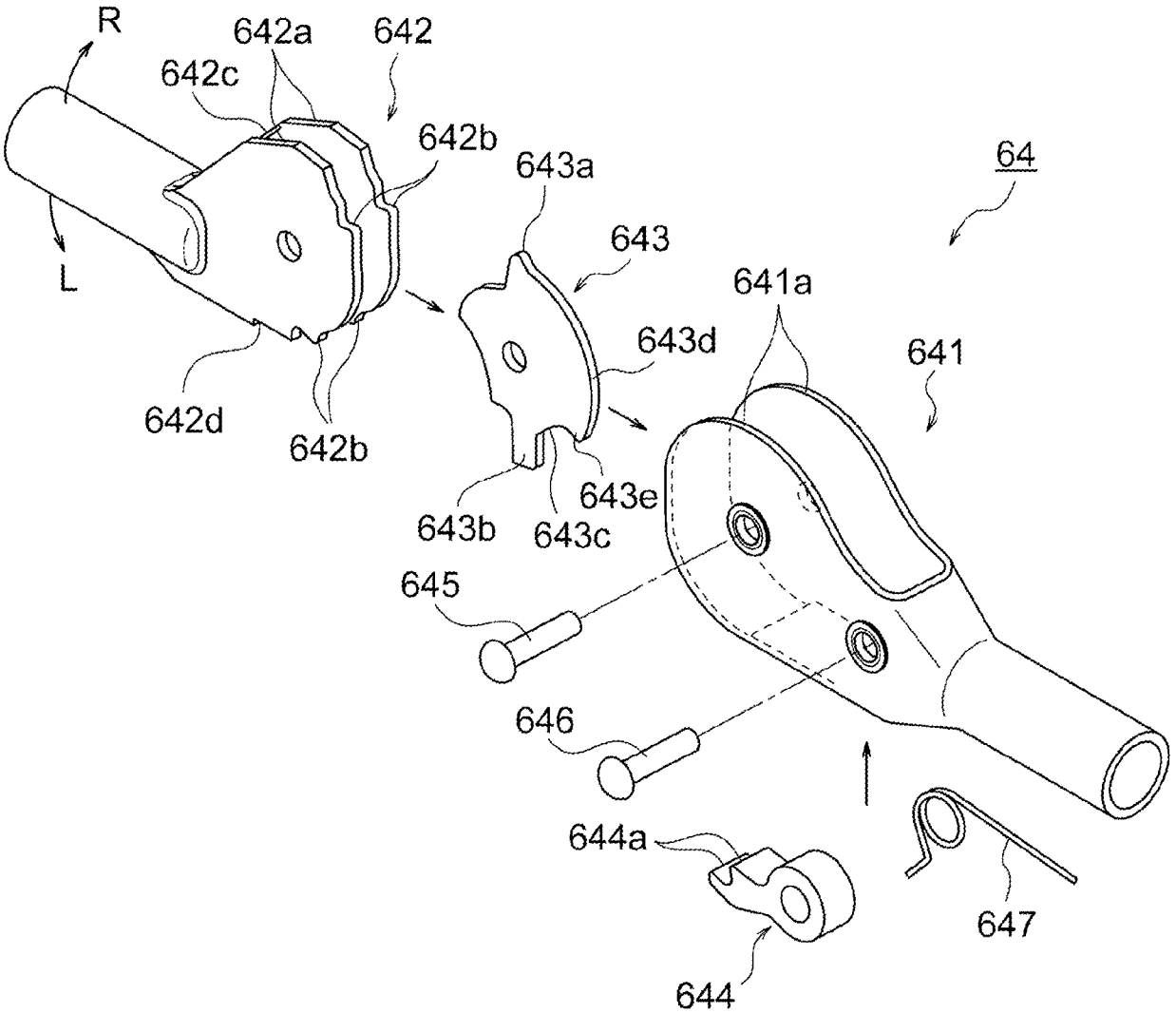
FIG. 5D is an exploded perspective view illustrating a joint part of the door open/close keeping member illustrated in FIG. 5A to FIG. 5C.

Next, a door open/close keeping member 60 and a door open/close mechanism 70 will be described as an example. The door open/close keeping member 60 is configured to maintain the side doors D1 and D2 in a state of being closed in the upward slope portion 11 at the entrance side, maintain the side doors D1 and D2 in a state of being opened in the second oven body 122, and maintain the side doors D1 and D2 again in a state of being closed in the first oven body 121. The door open/close mechanism 70 is configured to open and close the side doors D1 and D2 using the door open/close keeping member 60. FIG. 5A is a perspective view illustrating an example of the door open/close keeping member 60 used in the topcoat paint baking oven 1 according to one or more embodiments of the present invention, FIG. 5B is a back view of FIG. 5A, FIG. 5C is a plan view of FIG. 5A, and FIG. 5D is an exploded perspective view illustrating a joint part 64 of the door open/close keeping member 60 illustrated in FIG. 5A to FIG. 5C. With regard to the essential features of the paint baking oven and method according to the present invention, it suffices that the side doors D can be maintained in a state of being opened and in a state of being closed, and therefore a means for realizing this is not limited to the following features of the door open/close keeping member 60.

As illustrated in FIG. 5A to FIG. 5C, the door open/close keeping member 60 according to one or more embodiments of the present invention comprises a fixing frame 61 attached to a door, a fixing frame 62 attached to a body, an operation rod 63 fixed to the fixing frame 61, and a joint part 64 that couples the fixing frame 61 and the fixing frame 62 in an openable and closable manner.

The fixing frame 61 attached to a door is composed of a round rod or pipe made of metal and has a base end part 612 and a tip end part 611. The base end part 612 is fixed to the joint part 64, which will be described later, by means of welding, swaging, or the like. The tip end part 611 is folded into a predetermined shape so as to be capable of engaging with a working opening D11 of the inner panel of a side door D1. The operation rod 63 is fixed to the fixing frame 61 by welding or the like and extends to the window opening part of the side door D. The operation rod 63 is provided for operating the door open/close keeping member 60 using a door open/close mechanism 70 which will be described later.

The fixing frame 62 attached to a body is configured to include a frame 621, rotative body 622, and rotation-regulated body 623. The frame 621 is composed of a round rod or pipe made of metal and has a base end and a tip end. The base end is fixed to the joint part 64, which will be described later, by means of welding, swaging, or the like. The tip end is attached to the rotative body 622. The rotative body 622, which supports the frame 621, has a lower end that is inserted in a hole formed at the inner panel of a side sill B9. The rotation-regulated body 623, which supports the rotative body 622 in a rotatable manner, is placed on the side sill B9 of the door opening part B2. That is, as illustrated in FIG. 5A to FIG. 5C, the rotation-regulated body 623 is composed of an angle material having an L-shaped cross section and placed on the upper surface of the side sill B9 thereby to regulate its own rotation. In contrast, the rotative body 622 is supported by the rotation-regulated body 623 in a rotatable manner and the lower end of the rotative body 622 is inserted in the hole formed at the inner panel of the side sill B9. When the frame 621 moves in accordance with the opening/closing operation of the side door D, the rotative body 622 rotates accordingly.

As illustrated in FIG. 5D, the joint part 64 comprises a fixed part 641, rotative part 642, cam plate 643, reverse rotation regulating latch 644, rotation shaft 645, pivot shaft 646, and torsion coil spring 647. One end of the fixed part 641 is attached by means of welding, swaging or the like to the base end part 612 of the fixing frame 61 attached to a door. The rotative part 642 is attached by means of welding, swaging or the like to an end part of the frame 621 of the fixing frame 62 attached to a body. The rotative part 642 is rotatably supported by the fixed part 641 via the rotation shaft 645, that is, supported by the fixed part 641 so as to be capable of relative rotation around the rotation shaft 645 with respect to the fixed part 641.

Hereinafter, the direction of rotation of the rotative part 642 illustrated in FIG. 5C in a direction R in which a relative opening angle θ of the rotative part 642 to the fixed part 641 decreases, that is, the direction of closing the side door D, will be referred to as a "positive rotation direction R" of the rotative part 642. On the other hand, the direction of rotation of the rotative part 642 in the opposite direction L in which the relative opening angle θ of the rotative part 642 increases, that is, the direction of opening the side door D, will be referred to as a "negative rotation direction L" of the rotative part 642.

The fixed part 641 is provided with a pair of approximately circular shaft bush plates 641*a* and 641*a* that face each other to have a certain space while the rotative part 642 is provided with a pair of ratchet plates 642*a* and 642*a* that face each other to have a certain space. Outer edge parts of the ratchet plates 642*a* and 642*a* are each formed with a plurality (two in this example) of ratchet teeth 642*b* that are arranged side by side at a predetermined pitch. These ratchet teeth 642*b* are formed to have a certain pitch that allows the rotative part 642 to be engaged with the reverse rotation regulating latch 644 so that the opening angle θ of the rotative part 642 to the fixed part 641 can take the plurality of angle positions between the angle in a state of closing the side door D and the angle in a state of opening the side door D. In one or more embodiments of the present invention, the number of ratchet teeth 642*b* at each side, that is, the number of steps to which the opening angle θ of the rotative part 642 (opening angle of the side door D) can be adjusted, is not particularly limited. For example, one or more steps may be provided between the adjacent steps.

The rotative part 642 is provided integrally with a first abutting part 642*c* and a second abutting part 642*d* that come into contact with a first projecting part 643*a* and second projecting part 643*b* of the cam plate 643, respectively. The first abutting part 642*c* and the second abutting part 642*d* are provided at both the upper and lower end parts of the rotative part 642 between the ratchet plates 642*a* and 642*a*. As illustrated in FIG. 5D, the ratchet plates 642*a* and 642*a* of the rotative part 642 are disposed between the shaft bush plates 641*a* and 641*a* of the fixed part 641 and, in this state, the rotation shaft 645 composed of a rivet is inserted in respective shaft holes provided at the central parts of the shaft bush plates 641*a* and 641*a* and the central parts of the ratchet plates 642*a* and 642*a* and is fixed thereto so as not to drop off. This allows the rotative part 642 to be rotatably supported by the rotation shaft 645 relative to the fixed part 641. Further, the cam plate 643 is disposed between the ratchet plates 642*a* and 642*a* of the rotative part 642 and, in this state, the rotation shaft 645 is inserted in a shaft hole provided at the central part of the cam plate 643. This allows the cam plate 643, like the rotative part 642, to be rotatably supported by the rotation shaft 645 relative to the fixed part 641.

The reverse rotation regulating latch 644, which regulates the reverse rotation of the rotative part 642 (direction of opening the side door D), is disposed between the shaft bush plates 641*a* and 641*a* of the fixed part 641 and, in this state, the pivot shaft 646 composed of a rivet is inserted in shaft holes provided in the shaft bush plates 641*a* and 641*a* and a shaft hole provided in the reverse rotation regulating latch 644 and is fixed thereto so as not to drop off. This allows the reverse rotation regulating latch 644 to be pivotably supported by the pivot shaft 646 relative to the fixed part 641. The tip end of the reverse rotation regulating latch 644 is formed with two latch pieces 644*a* and 644*a* that can engage with the ratchet teeth 642*b* of the ratchet plates 642*a* and 642*a*. The reverse rotation regulating latch 644 is rotationally biased by the torsion coil spring 647 attached to the pivot shaft 646 in the clockwise direction, that is, the direction of engaging with the ratchet teeth 642*b* and 642*b*.

When the reverse rotation regulating latch 644 pivots about the pivot shaft 646 in the clockwise direction of FIG. 5D, the latch pieces 644*a* and 644*a* simultaneously engage with two adjacent ratchet teeth 642*b* and 642*b* of the same step thereby to regulate the rotation of the rotative part 642 in the negative rotation direction L (i.e. the reverse rotation direction, or the direction of opening the side door D). On the other hand, when the reverse rotation regulating latch 644 pivots in the counterclockwise direction, the latch pieces 644*a* and 644*a* are simultaneously released from the ratchet teeth 642*b* and 642*b* thereby to allow the rotation of the rotative part 642 in the negative rotation direction L (i.e. the reverse rotation direction, or the direction of opening the side door D). Thus, in a state in which the latch pieces 644*a* of the reverse rotation regulating latch 644 engage with the ratchet teeth 642*b*, the rotation of the rotative part 642 in the negative rotation direction L (direction of opening the side door D) is regulated as described above, but when it is tried to rotate the rotative part 642 from this state in the positive rotation direction R (direction of closing the side door D), the ratchet teeth 642*b* press the latch pieces 644*a* against the biasing force of the torsion coil spring 647 in the release direction thereby to release the engagement between the latch pieces 644*a* and the ratchet teeth 642*b*.

As illustrated in FIG. 5D, approximately half of the outer edge part of the cam plate 643 at the side facing the reverse rotation regulating latch 644 is provided with a first projecting part 643*a* and a second projecting part 643*b* that come into contact respectively with the first abutting part 642*c* and second abutting part 642*d* of the rotative part 642, an edge recessed part 643*c* for allowing the engagement of the latch pieces 644*a* with the ratchet teeth 642*b*, an edge projecting part 643*d* formed into a slightly larger arc shape than the ratchet plates 642*a* so as to regulate the engagement of the latch pieces 644*a* with the ratchet teeth 642*b*, and a guide part 643*e* formed to be inclined from the edge recessed part 643*c* to the edge projecting part 643*d*.

In the joint part 64 configured as the above, in a state in which the rotative part 642 is opened with respect to the fixed part 641 as illustrated in FIG. 5D, the latch pieces 644*a* of the reverse rotation regulating latch 644 are located in the edge recessed part 643*c* of the cam plate 643 and the reverse rotation regulating latch 644 is thereby biased by the biasing force of the torsion coil spring 647 in the engagement direction to engage the latch pieces 644*a* with the ratchet teeth 642*b*. This regulates the rotation of the rotative part 642 in the direction in which the opening angle θ of the rotative part 642 increases, that is, in the negative rotation direction L (direction of opening the side door D). When the rotative part 642 is rotated from this state in the direction in which the opening angle θ decreases, that is, in the positive rotation direction R (direction of closing the side door D), the ratchet teeth 642*b* press the latch pieces 644*a* against the biasing force of the torsion coil spring 647 in the release direction, so that the latch pieces 644*a* override the ratchet teeth 642*b* and then engage with the next ratchet teeth 642*b* due to the biasing force of the torsion coil spring 647. This regulates the rotation of the rotative part 642 again in the negative rotation direction L (direction of opening the side door D). In this manner, the latch pieces 644*a* of the reverse rotation regulating latch 644 are sequentially moved between two pair of ratchet teeth 642*b* thereby to allow the rotation of the rotative part 642 in the positive rotation direction R (positive rotation in the direction of closing the side door D), while on the other hand, the latch pieces 644*a* engage with the ratchet teeth 642*b* thereby to regulate the rotation of the rotative part 642 in the negative rotation direction L (negative rotation in the direction of opening the side door D). In other words, by holding the operation rod 63 of the door open/close keeping member 60 to press it in the direction of closing the side door D, the side door D comes to a closed state from an opened state.

In the joint part 64 according to one or more embodiments of the present invention, an operation to cancel the regulation of rotation of the rotative part 642 in the negative rotation direction L (direction of opening the side door D), that is, a regulation cancel operation for reverse rotation, is performed in the following manner. First, the rotative part 642 is rotated largely in the positive direction (direction of closing the side door D) until the opening angle θ of the rotative part 642 becomes less than a predetermined regulation cancel angle. On the way of this positive rotation operation, the first abutting part 642*c* of the rotative part 642 comes into contact with the first projecting part 643*a* of the cam plate 643 to rotate the cam plate 643 together with the rotative part 642 in the positive direction. In accordance with this positive rotation operation, the latch pieces 644*a* of the reverse rotation regulating latch 644 are pressed against the biasing force of the torsion coil spring 647 in the release direction along the guide part 643*e* of the cam plate 643 thereby to come to a state of running on the edge projecting part 643*d*. Thus, a state is maintained in which the engagement of the latch pieces 644*a* with the ratchet teeth 642*b* is released, that is, a state is maintained in which the regulation of rotation of the rotative part 642 in the negative rotation direction L (direction of opening the side door D) is canceled. This state therefore allows the rotation of the rotative part 642 in the negative rotation direction L. Then, when the rotative part 642 is rotated in the negative direction while the regulation of rotation of the rotative part 642 in the negative rotation direction L is canceled, the second abutting part 642*d* of the rotative part 642 comes into contact with the second projecting part 643*b* of the cam plate 643 to rotate the cam plate 643 together with the rotative part 642 in the negative direction. When the rotative part 642 is rotated until the opening angle θ comes to the maximum opening angle, the second abutting part 642*d* of the rotative part 642 presses the second projecting part 643*b* of the cam plate 643 to rotate the cam plate 643 in the negative direction. Through this operation, the latch pieces 644*a* of the reverse rotation regulating latch 644 pass from the edge projecting part 643*d* of the cam plate 643 across the guide part 643*e* to be located inside the edge recessed part 643*c*. This allows the latch pieces 644*a* to engage with the ratchet teeth 642*b* thereby to regulate the rotation of the rotative part 642 in the negative rotation direction L (direction of opening the side door D).

In short, in the second oven body 122 illustrated in FIG. 3B and FIG. 4A (or FIG. 4C), the side doors D1 and D2 are in a state of being fully opened or opened with an angle close to that in the fully-opened state and this state corresponds to the case in which the angle θ of the joint part 64 of the door open/close keeping member 60 is large. In contrast, in the first oven body 121 illustrated in FIG. 3B and FIG. 4B, the side doors D1 and D2 are in a state of being slightly opened with an angle close to that in the fully-closed state and this state corresponds to the case in which the angle θ of the joint part 64 of the door open/close keeping member 60 is small. In the upward slope portion 11 at the left side of FIG. 3B, the side doors D1 and D2 are in a state of being slightly opened with an angle close to that in the fully-closed state, so the rotation in the direction to the fully-opened state is regulated. When the side doors D1 and D2 are moved from this state further in the direction of closing them (direction of decreasing θ), the regulation of the reverse rotation of the joint part 64 is canceled as described above. Then, when, from this state, the side doors D1 and D2 are opened in the direction to the fully-opened state (direction of increasing θ), the side doors D1 and D2 are brought into and maintained in a state of being fully opened or opened with an angle close to that in the fully-opened state. In contrast, in the second oven body 122 of FIG. 3B, the side doors D1 and D2 are in a state of being fully opened or opened with an angle close to that in the fully-opened state, so the rotation of the joint part 64 is allowed in the positive rotation direction as described above. When the side doors D1 and D2 are closed at the end of the second oven body 122, therefore, the side doors D1 and D2 are merely pressed in the direction of closing them, thereby to be brought into and maintained in a state of being slightly opened with an angle close to that in the fully-closed state.

To perform such opening operation and closing operation for the side doors D1 and D2, as illustrated in FIG. 3B, the door open/close mechanism 70 is provided in a distributed formation at the right and left of the start and end of the second oven body 122. The door open/close mechanism 70 according to one or more embodiments of the present invention includes door open mechanisms 71 that are disposed at the start of the second oven body 122 (or may be disposed at the end of the preceding upward slope portion 11), door close mechanisms 72 that are disposed at the end of the second oven body 122, and limit switches or the like (not illustrated) that detect that the vehicle bodies B arrive at the door open mechanisms 71 and the door close mechanisms 72.

As illustrated in FIG. 5B, each door open mechanism 71 is configured to include an arm 711 that holds the operation rod 63 of the door open/close keeping member 60 (the arm 711 has at its tip end a hand 713 for holding the operation rod 63) and a drive unit 712 that drives the arm 711 back and forth. As described above, when the side doors D1 and D2 are opened from the closed state, the side doors D1 and D2 are once moved in the direction of closing the side doors D1 and D2 and then moved in the direction of opening them. It therefore suffices that the drive unit 712 can operate the arm 711 to perform this operation. After the limit switches or the like detect that the vehicle body B arrives at a predetermined position with respect to the door open mechanisms 71, the drive unit 712 operates the arm 711 to move ahead, hold the operation rod 63, move ahead in the direction of closing, move backward to the fully-opened state or to the state with an opening degree close to that in the fully-opened state, release holding of the operation rod 63, and move backward to the initial position. Such an operation of the drive unit 712 can be achieved using a robot or dedicated driving apparatus.

On the other hand, each door close mechanism 72 is configured to include, as denoted by reference numerals in parentheses in FIG. 5B, an arm 721 that holds the operation rod 63 of the door open/close keeping member 60 (the arm 721 has at its tip end a hand 723 for holding the operation rod 63) and a drive unit 722 that drives the arm 721 back and forth. As described above, when the side doors D1 and D2 are closed from the opened state, it is enough for the side doors D1 and D2 to be merely moved from the opened state in the direction of closing the side doors D1 and D2. It therefore suffices that the drive unit 722 can operate the arm 721 to perform this operation. After the limit switches or the like detect that the vehicle body B arrives at a predetermined position with respect to the door close mechanisms 72, the drive unit 722 operates the arm 721 to move ahead, hold the operation rod 63, move ahead in the direction of closing to an opening degree close to that in the fully-closed state, release holding of the operation rod 63, and move backward to the initial position. Such an operation of the drive unit 722 can be achieved using a robot or dedicated driving apparatus.

Figure 6:
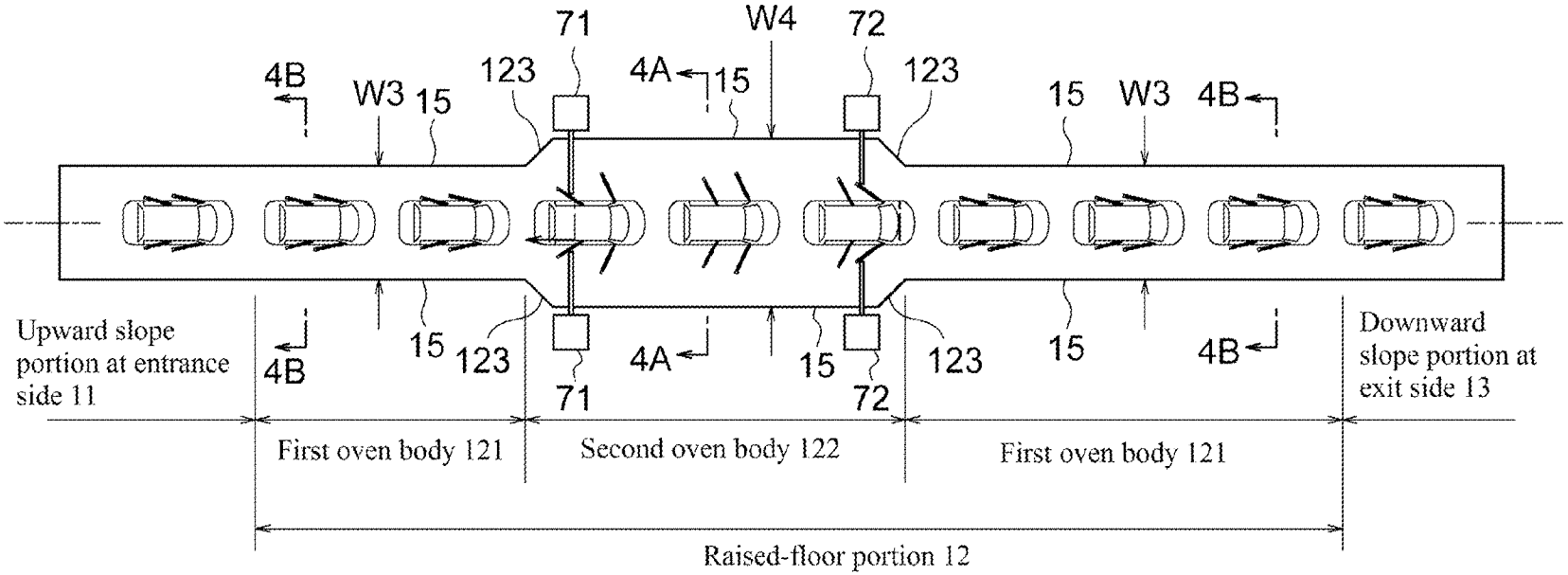
FIG. 6 is a plan view illustrating a schematic configuration of a topcoat paint baking oven according to another embodiment of the present invention.
Figure 7:
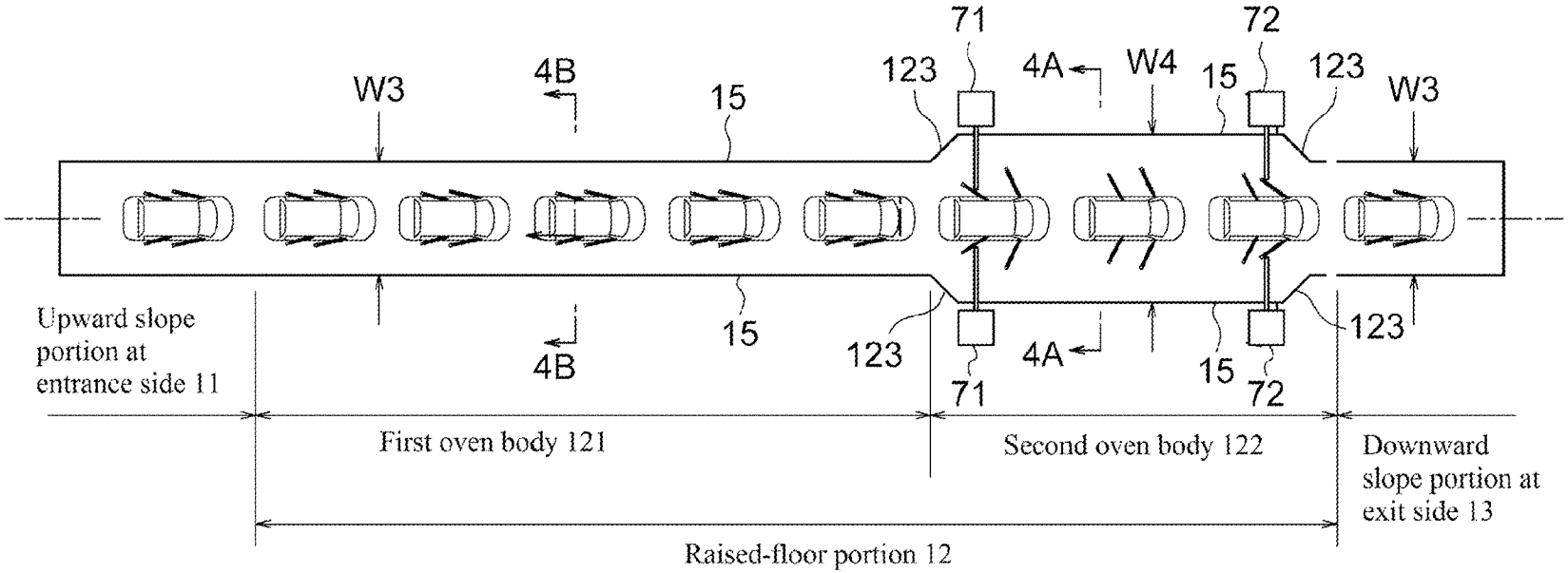
FIG. 7 is a plan view illustrating a schematic configuration of a topcoat paint baking oven according to still another embodiment of the present invention.
Figure 8:
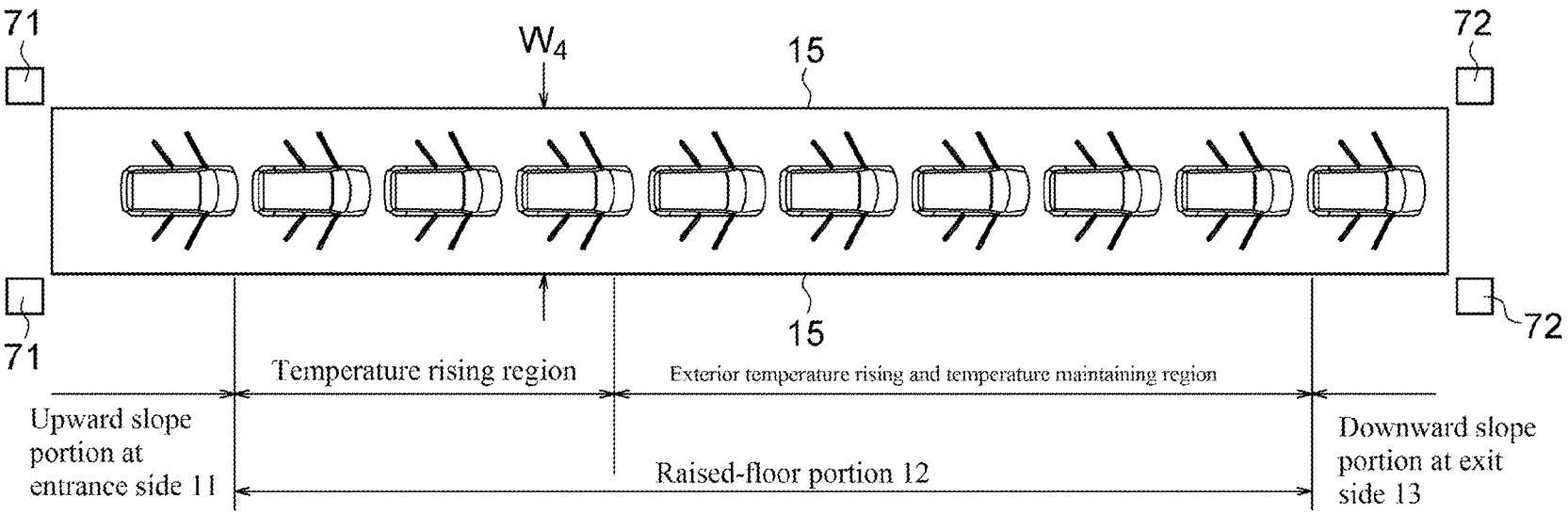
FIG. 8 is a plan view illustrating a schematic configuration of a topcoat paint baking oven according to yet another embodiment of the present invention.

FIG. 6 is a plan view illustrating a schematic configuration of a topcoat paint baking oven according to another embodiment of the present invention. The cross section along line 4A-4A in FIG. 6 has the same structure as that illustrated in FIG. 4A and the cross section along line 4B-4B in FIG. 6 has the same structure as that illustrated in FIG. 4B. In the above-described topcoat paint baking oven 1 illustrated in FIG. 3A and FIG. 3B according to one or more embodiments of the present invention, the second oven body 122 is provided at the upstream side start end of the raised-floor portion 12, but it suffices for the topcoat paint baking oven according to the present invention that the second oven body 122 is provided at least at any location of the raised-floor portion 12. For example, the topcoat paint baking oven 1 according to another embodiment illustrated in FIG. 6 is an example in which the first oven body 121 is provided at the upstream side start end of the raised-floor portion 12 and the second oven body 122 is provided to follow the first oven body 121. Also in such a topcoat paint baking oven 1 according to another embodiment, the baking in the state of opening the side doors D and the baking in the state of closing the side doors D can be realized as in the topcoat paint baking oven 1 illustrated in FIG. 3A and FIG. 3B. FIG. 7 illustrates an example of the topcoat paint baking oven 1 according to still another embodiment in which the first oven body 121 is provided at the upstream side of the raised-floor portion 12 and the second oven body 122 is provided at the downstream side. Also in such a topcoat paint baking oven 1 according to still another embodiment, the baking in the state of opening the side doors D and the baking in the state of closing the side doors D can be realized as in the topcoat paint baking oven 1 illustrated in FIG. 3A and FIG. 3B. FIG. 8 illustrates an example of the topcoat paint baking oven 1 according to yet another embodiment in which the whole raised-floor portion 12 is the second oven body 122 with a wide width, the temperature rising region at the upstream side is provided with the second hot air blowoff ports 26 illustrated in FIG. 4A or FIG. 4C, and the exterior temperature rising and temperature maintaining region at the downstream side is provided with the first hot air blowoff ports 25 illustrated in FIG. 4B. Also in such a topcoat paint baking oven 1 according to yet another embodiment, the baking in the state of opening the side doors D can be realized as in the topcoat paint baking oven 1 illustrated in FIG. 3A and FIG. 3B.

The topcoat paint baking oven 1 and topcoat paint baking method according to one or more embodiments of the present invention have the following actions and effects:

In most cases, a vehicle body B is configured to include a site that is easily exposed to hot wind and a site that is not easily exposed to hot wind. For example, even when vehicle bodies are conveyed into the topcoat paint baking oven 1 in a state of closing the side doors D, the hot air is less likely to go around into the narrow portions N1 and N2 in the vicinities of the hinges H1 and H2 of the side doors D. In contrast, the body exterior parts such as outer panels of the side doors D can be directly blown with the hot air and thus easily heated. For these reasons, if the setting condition for the hot air temperature, time of passage and the like in the topcoat paint baking oven 1 is adapted to the coated surfaces of the narrow portions N1 and N2 which cannot be easily heated, not only the body exterior parts which can be easily heated will be beyond the quality assurance standard to a large degree to needlessly consume energy, but also overbaking may possibly occur in some cases to rather deteriorate the coating quality. If, on the other hand, the setting condition for the hot air temperature, time of passage and the like in the topcoat paint baking oven 1 is adapted to the body exterior parts which can be easily heated, the baking condition for the coating films of the narrow portions N1 and N2 will not satisfy the quality assurance standard to cause so-called poor baking, and the deterioration in the coating film properties and delamination of the coating film may possibly occur. According to one or more embodiments of the present invention, in the second oven body 122 in which the vehicle bodies are conveyed in a state of opening the side doors D, the hot air is blown locally toward the coated surfaces of the narrow portions N1 and N2 which are relatively difficult to be heated, thereby to allow the baking condition to be uniform across the whole area of the coating film of the vehicle body B, and not only the coating film quality is improved but also energy saving can be achieved. Moreover, the first oven body 121 has a narrow oven width and the total space for the oven body 10 can thereby be minimized.

(2) With regard to the second hot air blowoff ports 26 according to one or more embodiments of the present invention, when the controller 267 receives a signal that indicates that a vehicle body B arrives at a predetermined position and a signal that represents the vehicle type of the vehicle body B, the controller 267 controls the first driver 265 and the second driver 266 so that the blowing direction of the blowoff port 261 is suitable for the vehicle type of the vehicle body B. This allows the hot air blown from each second hot air blowoff port 26 to be oriented to the hinge positions determined by the vehicle type, as illustrated in FIG. 4D and FIG. 4E, and it is thus ensured that the baking condition for the coated surfaces of the narrow portions N1 and N2 can be more readily satisfied.

(3) The second oven body 122 according to one or more embodiments of the present invention is provided only with the second hot air blowoff ports 26 which blow the hot air toward the vicinities of hinges H of the vehicle bodies B. This can not only locally raise the temperature of the coated surfaces of the narrow portions N1 and N2 in the vicinities of the hinges H but also prevent the dust around the narrow portions N1 and N2 from attaching to the body exterior parts of the vehicle bodies B.

(4) According to one or more embodiments of the present invention as illustrated in FIG. 3A, FIG. 3B, FIG. 6 and FIG. 7, the side surfaces connecting between the end parts of the side wall surfaces 15 of the first oven body 121 and the end parts of the side wall surfaces 15 of the second oven body 122 are provided as slant wall surfaces 123 that have decreasing dimensions from the second oven body 122 to the first oven body 121. This can therefore make smooth the flow of hot air generated inside the first oven body 121 and the second oven body 122 and suppress the uneven temperature distribution due to the hot air staying in the boundary part between the first oven body 121 and the second oven body 122.

The above hot air supply device 20 corresponds to the hot air supplier of the present invention and the second hot air blowoff ports 26 correspond to the spot blowoff port of the present invention.

DESCRIPTION OF REFERENCE NUMERALS

| | | | | | |
|---|---|---|---|---|---|
| PRL | Press-forming process line | | | | |
| WL | Shell body assembly process line (Welding process line) | | | | |
| ASL | Vehicle component assembly process line (Outfitting process line) | | | | |
| PL | Coating process line | | | | |
| | P1 | Under coating process (Electrodeposition coating process) | | | |
| | | P11 | Pretreatment process for electrodeposition coat | | |
| | | P12 | Electrodeposition paint coating process | | |
| | | P13 | Electrodeposition paint baking process | | |
| | P2 | Sealing process | | | |
| | P3 | Intermediate coating process | | | |
| | | P31 | Intermediate paint coating process | | |
| | | P32 | Intermediate paint baking process | | |
| | P4 | Wet sanding process | | | |
| | | P41 | Wet sanding drying process | | |
| | P5 | Topcoat process | | | |
| | | P51 | Topcoat paint coating process | | |
| | | P52 | Topcoat paint baking process | | |
| | P6 | Final inspection process | | | |
| | P7 | Intermediate and topcoat coating process | | | |
| | | P71 | Intermediate paint and topcoat paint coating process | | |
| | | P72 | Intermediate paint and topcoat paint baking process | | |
| D/L | Drop-lifter | | | | |
| B | Shell body (Object to be coated) | | | | |
| | B1 | Main shell body | | | |
| | | B2 | Front door opening part | | |
| | | B3 | Rear door opening part | | |
| | | B4 | Front pillar | | |
| | | B5 | Center pillar | | |
| | | B6 | Front under body | | |
| | | B7 | Rear under body | | |
| | | B8 | Roof side rail | | |
| | | B9 | Side sill | | |
| | | B10 | Rear pillar | | |
| | | B11 | Front fender | | |
| | | B12 | Rear fender | | |
| | | B13 | Roof | | |
| | F | Hood (Bonnet) | | | |
| | T | Trunk lid | | | |
| | D | Side door | | | |
| | | D1 | Front door | | |
| | | H1 (H) | | | Hinge |
| | | | | H11, H12 | Hinge bracket |
| | | | | H13 | Hinge pin |
| | D2 | Rear door | | | |
| | | H2 (H) | | | Hinge |
| | | | | H21, H22 | Hinge bracket |
| | | | | H23 | Hinge pin |
| N1, N2 | Narrow portion | | | | |
| W1 | Body width in a state of closing side doors | | | | |
| W2 | Body width in a state of opening side doors | | | | |
| 1 | Topcoat paint baking oven | | | | |
| | 10 | Oven body | | | |
| | | 11 | Upward slope portion at an entrance side | | |
| | | 12 | Raised-floor portion | | |
| | | | 121 | First oven body | |
| | | | 122 | Second oven body | |
| | | | 123 | Slant wall surface | |
| | | 13 | Downward slope portion at an exit side | | |
| | | 14 | Ceiling surface | | |
| | | 15 | Side wall surface | | |
| | | 16 | Floor surface | | |
| | 20 | Hot air supply device | | | |
| | | 21 | Air supply fan | | |
| | | 22 | Air supply filter | | |
| | | 23 | Burner | | |
| | | 24 | Air supply duct | | |
| | | 25 | First hot air blowoff port | | |
| | | 26 | Second hot air blowoff port | | |
| | | | 261 | Blowoff port | |
| | | | 262, 262a, 262b | | Gimbal, Axial body |
| | | | 263 | Supporter | |
| | | | 264 | Base | |
| | | | 265 | First driver | |
| | | | 266 | Second driver | |
| | | | 267 | Controller | |
| | 30 | Air exhauster | | | |
| | | 31 | Air exhaust fan | | |
| | | 32 | Air exhaust filter | | |
| | | 33 | Air exhaust duct | | |
| | | 34 | Air intake port | | |
| | 40 | Conveyor | | | |
| | | 41 | Rail | | |
| | 50 | Transfer trolley | | | |
| | | 51 | Base | | |
| | | 52 | Front attachment | | |
| | | 53 | Rear attachment | | |
| | | 54 | Wheel | | |
| | 60 | Door open/close keeping member | | | |
| | | 61 | Fixing frame attached to a door | | |
| | | | 611 | Base end part | |
| | | | 612 | Tip end part | |
| | | 62 | Fixing frame attached to a body | | |
| | | | 621 | Frame | |
| | | | 622 | Rotative body | |
| | | | 623 | Rotation-regulated body | |
| | | 63 | Operation rod | | |
| | | 64 | Joint part | | |
| | | | 641 | Fixed part | |
| | | | | 641a | Shaft bush plate |
| | | | 642 | Rotative part | |
| | | | | 642a | Ratchet plate |
| | | | | 642b | Ratchet tooth |
| | | | | 642c | First abutting part |
| | | | | 642d | Second abutting part |
| | | | 643 | Cam plate | |
| | | | | 643a | First projecting part |
| | | | | 643b | Secondprojecting part |
| | | | | 643c | Edge recessed part |
| | | | | 643d | Edge projecting part |
| | | | | 643e | Guide part |
| | | | 644 | Reverse rotation regulating latch | |
| | | | | 644a | Latch piece |
| | | | 645 | Rotation shaft | |
| | | | 646 | Pivot shaft | |
| | | | 647 | Torsion coil spring | |
| | 70 | Door open/close mechanism | | | |
| | | 71 | Door open mechanism | | |
| | | | 711 | Arm | |

-continued

| | | |
|---|---|---|
| | 712 | Drive unit |
| | 713 | Hand |
| 72 | Door close mechanism | |
| | 721 | Arm |
| | 722 | Drive unit |
| | 723 | Hand |

The invention claimed is:

1. A paint baking oven comprising:

an oven body in which a vehicle body is conveyed, the vehicle body having a main shell body to which a lid part is attached via a hinge, the vehicle body including a body exterior part and a coated surface of the main shell body and the lid part in a vicinity of the hinge; and a hot air supplier configured to supply hot air into the oven body to bake a wet coating film applied to the body exterior part and the coated surface, wherein the oven body includes a spot baking region in which the hot air is blown only toward the coated surface, in a state of opening the lid part, to locally bake the wet coating film applied to the coated surface, wherein the vehicle body is conveyed in a state of opening the lid part at least in the spot baking region, and the hot air supplier includes a spot blowoff port configured to blow the hot air toward the wet coating film applied to the coated surface in the vicinity of the hinge in the state of opening the lid part.

2. The paint baking oven according to claim 1, wherein the oven body includes a temperature maintaining region in which the hot air is blown to the vehicle body to bake the wet coating film applied to the vehicle body.

3. The paint baking oven according to claim 1 in which vehicle bodies of different vehicle types are conveyed, wherein the hot air supplier includes a driver configured to vary a blowing direction of the hot air toward the coated surface, and the paint baking oven further comprises:

a vehicle type detector configured to detect the vehicle type of the vehicle body that arrives at the spot baking region; and a controller configured to output a control signal to the driver in accordance with the vehicle type detected by the vehicle type detector and control the blowing direction of the hot air from the spot blowoff port.

4. The paint baking oven according to claim 2, wherein the spot baking region is provided at an entrance side of the oven body and the temperature maintaining region is provided downstream of the spot baking region.

5. A paint baking method comprising:

preparing a paint baking oven comprising an oven body and a hot air supplier, the hot air supplier supplying hot air into the oven body; and baking a wet coating film applied to a vehicle body while conveying the vehicle body, the vehicle body having a main shell body to which a lid part is attached via a hinge, the vehicle body including a body exterior part and a coated surface of the main shell body and the lid part in a vicinity of the hinge, wherein the baking the wet coating film applied to a vehicle body includes blowing the hot air only toward the coated surface, in a state of opening the lid part, to locally bake the wet coating film applied to the coated surface, and at least when the wet coating film applied to the coated surface is locally baked, the vehicle body is conveyed in a state of opening the lid part and the hot air is blown toward the wet coating film applied to the coated surface in the vicinity of the hinge in the state of opening the lid part.

6. The paint baking method according to claim 5, comprising a temperature maintaining process for blowing the hot air to the vehicle body to bake the wet coating film applied to the vehicle body.

7. The paint baking method according to claim 5, wherein vehicle bodies of different vehicle types are conveyed, and when the wet coating film applied to the coated surface is locally baked in a process, a blowing direction of the hot air from the hot air supplier is controlled in accordance with the vehicle type of the vehicle body that arrives at the process and the hot air is blown toward the coated surface.

8. The paint baking method according to claim 6, wherein the wet coating film applied to the coated surface is locally baked upstream of the temperature maintaining process.

* * * * *